US010518545B2

(12) United States Patent
Ono et al.

(10) Patent No.: US 10,518,545 B2
(45) Date of Patent: Dec. 31, 2019

(54) LIQUID CARTRIDGE INCLUDING CIRCUIT BOARD AND PIVOTING MEMBER

(71) Applicant: BROTHER KOGYO KABUSHIKI KAISHA, Nagoya-shi, Aichi-ken (JP)

(72) Inventors: Akihito Ono, Nagoya (JP); Kosuke Nukui, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/119,198

(22) Filed: Aug. 31, 2018

(65) Prior Publication Data

US 2019/0299635 A1 Oct. 3, 2019

(30) Foreign Application Priority Data

Mar. 29, 2018 (JP) ..... 2018-064180

(51) Int. Cl.
*B41J 2/175* (2006.01)

(52) U.S. Cl.
CPC ..... *B41J 2/17526* (2013.01); *B41J 2/17553* (2013.01)

(58) Field of Classification Search
CPC .. B41J 2/17526; B41J 2/17553; B41J 2/1752; B41J 2/17503; B41J 2/17513
USPC ..... 347/85–87
See application file for complete search history.

(56) References Cited

U.S. PATENT DOCUMENTS 8,562,116 B2 * 10/2013 Kanbe ..... B41J 2/1752 347/84
9,108,416 B2 * 8/2015 Norikane ..... B41J 2/1752
9,550,366 B2 * 1/2017 Okazaki ..... B41J 2/17543
2007/0222838 A1 9/2007 Wanibe
2013/0278683 A1 10/2013 Kanbe et al.
2018/0093487 A1 4/2018 Tanaka et al.
2018/0244062 A1 8/2018 Kanbe et al.

FOREIGN PATENT DOCUMENTS

EP 2 000 311 A2 12/2008
EP 2 653 313 A2 10/2013
JP 2011-167966 A 9/2011
JP 2013-49164 A 3/2013
JP 2018-52005 A 4/2018

OTHER PUBLICATIONS

Extended European Search Report issued in related European Patent Application No. 18192088.5, dated Dec. 12, 2018.

* cited by examiner

*Primary Examiner* — An H Do
(74) *Attorney, Agent, or Firm* — Merchant & Gould P.C.

(57) ABSTRACT

A liquid cartridge is configured to be inserted into an attachment portion of a printing device in an insertion direction and attached thereto in an upright posture. The liquid cartridge includes: a housing having a contact; a circuit board; and a pivoting member. The circuit board is movable between a first position and a second position relative to the housing. The contact of the cartridge faces upward in the upright posture when the circuit board is in the first position. The contact of the cartridge slopes relative to the insertion direction in the upright posture and is electrically connectable to a contact of the device in an attached state of the liquid cartridge when the circuit board is in the second position. The pivoting member is pivotably supported by the housing about a pivot axis and moves the circuit board between the first position and the second position.

20 Claims, 20 Drawing Sheets

LIQUID CARTRIDGE INCLUDING CIRCUIT BOARD AND PIVOTING MEMBER

CROSS REFERENCE TO RELATED APPLICATION

This application claims priority from Japanese Patent Application No. 2018-064180 filed Mar. 29, 2018. The entire content of the priority application is incorporated herein by reference.

TECHNICAL FIELD

The present disclosure relates to a liquid cartridge storing liquid therein, and a system including the liquid cartridge, and an attachment portion to which the liquid cartridge is attachable.

BACKGROUND

One conventional system known in the art includes an ink cartridge, and an inkjet recording device.

Some ink cartridges are provided with a circuit board (see Japanese Patent Application Publication No. 2013-49164). A memory is mounted on the circuit board for storing such information as a color and material composition of ink stored in the cartridge, a residual quantity of ink, and the like. Electrodes are also formed on the circuit board. Electrical connections are formed between the electrodes on the ink cartridge and the contacts in the attachment portion when the ink cartridge is mounted in the attachment portion, enabling the inkjet recording device to read information stored in the memory.

SUMMARY

However, conduction failure may occur between the electrodes and the contacts if the ink cartridge is attached to the attachment portion while dust or other foreign matter remains deposited on the electrodes formed on the circuit board. When the electrodes on the circuit board face upward, as in the ink cartridge described above, foreign matter deposited on the electrodes is not likely to fall off the electrodes.

In view of the foregoing, it is an object of the present disclosure to provide a liquid cartridge capable of reducing the occurrence of conduction failure between electrodes on the circuit board and contacts in the attachment portion caused by foreign matter deposited on the electrodes. It is another object of the present disclosure to provide a system equipped with this liquid cartridge.

In order to attain the above and other objects, according to one aspect, the present disclosure provides a liquid cartridge configured to be inserted into an attachment portion of a printing device in an insertion direction crossing a gravitational direction and attached to the attachment portion in an upright posture, the attachment portion including a contact. The liquid cartridge includes: a housing; a circuit board; and a pivoting member. The housing includes: a liquid chamber; and a liquid passage. The liquid chamber stores liquid therein. The liquid passage is in communication with the liquid chamber and extends forward in the insertion direction from the liquid chamber. The liquid passage has a front end in the insertion direction. An opening is formed in the front end. The circuit board includes: a contact; and a memory. The contact of the cartridge is electrically connectable to the contact of the device in an attached state of the liquid cartridge to the attachment portion. The contact of the cartridge faces upward in the upright posture when the circuit board is in the first position. The contact of the cartridge slopes relative to the insertion direction in the upright posture and is electrically connectable to the contact of the device in the attached state of the liquid cartridge when the circuit board is in the second position. The memory is electrically connected to the contact of the cartridge. The pivoting member is pivotably supported by the housing about a pivot axis extending in a widthwise direction perpendicular to the insertion direction and the gravitational direction. The pivoting member is configured to move the circuit board between the first position and the second position.

According to another aspect, the present disclosure also provides a liquid cartridge configured to be inserted into an attachment portion of a printing device in an insertion direction crossing a gravitational direction and attached to the attachment portion in an upright posture, the attachment portion including a contact. The liquid cartridge includes: a housing; a circuit board; and a pivoting member. The housing includes: a liquid chamber; and a liquid passage. The liquid chamber stores liquid therein. The liquid passage is in communication with the liquid chamber and extends forward in the insertion direction from the liquid chamber. The liquid passage has a front end in the insertion direction. An opening is formed in the front end. The circuit board is movable between a first position and a second position relative to the housing. The circuit board includes: a contact; and a memory. The contact of the cartridge is electrically connectable to the contact of the device in an attached state of the liquid cartridge to the attachment portion. The contact of the cartridge slopes relative to the insertion direction in the upright posture. The contact of the cartridge is disconnected from the contact of the device when the circuit board is in the first position. The contact of the cartridge is electrically connected to the contact of the device in the attached state of the liquid cartridge when the circuit board is in the second position. The memory is electrically connected to the contact of the cartridge. The pivoting member is pivotably supported by the housing about a pivot axis extending in a widthwise direction perpendicular to the insertion direction and the gravitational direction. The pivoting member is configured to move the circuit board between the first position and the second position.

According to still another aspect, the present disclosure also provides a system including: the liquid cartridge according to the above-stated aspects; and an attachment portion of a printing device. The liquid cartridge is configured to be inserted into the attachment portion in the insertion direction and attached to the attachment portion in the upright posture. The attachment portion includes: a holder; a circulation tube; and a connector. The liquid cartridge is inserted in the holder. The liquid in the liquid chamber is allowed to flow out of the liquid chamber of the liquid cartridge through the circulation tube in the attached state of the liquid cartridge. The connector is disposed in the holder. The connector includes: a contact; a first wall; and a second wall. The contact of the device is configured to make contact with the contact of the cartridge in the attached state of the liquid cartridge. The first wall has a first lower end in the gravitational direction. The first lower end is positioned lower than the contact of the device in the gravitational direction. The second wall is spaced apart from the first wall in the insertion direction. The second wall has a second lower end in the gravitational direction. The second lower end is positioned lower than the contact of the device in the gravitational direction. The contact of the device is positioned between the first wall and the second wall in the insertion direction.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Hereinafter, an embodiment of the disclosure will be described in detail while referring to accompanying drawings. It would be apparent to those skilled in the art that the embodiment described below is merely an example of the present disclosure and modifications and variations may be made therein without departing from the scope of the disclosure.

<Overview of Printer 10>

Figure 1:
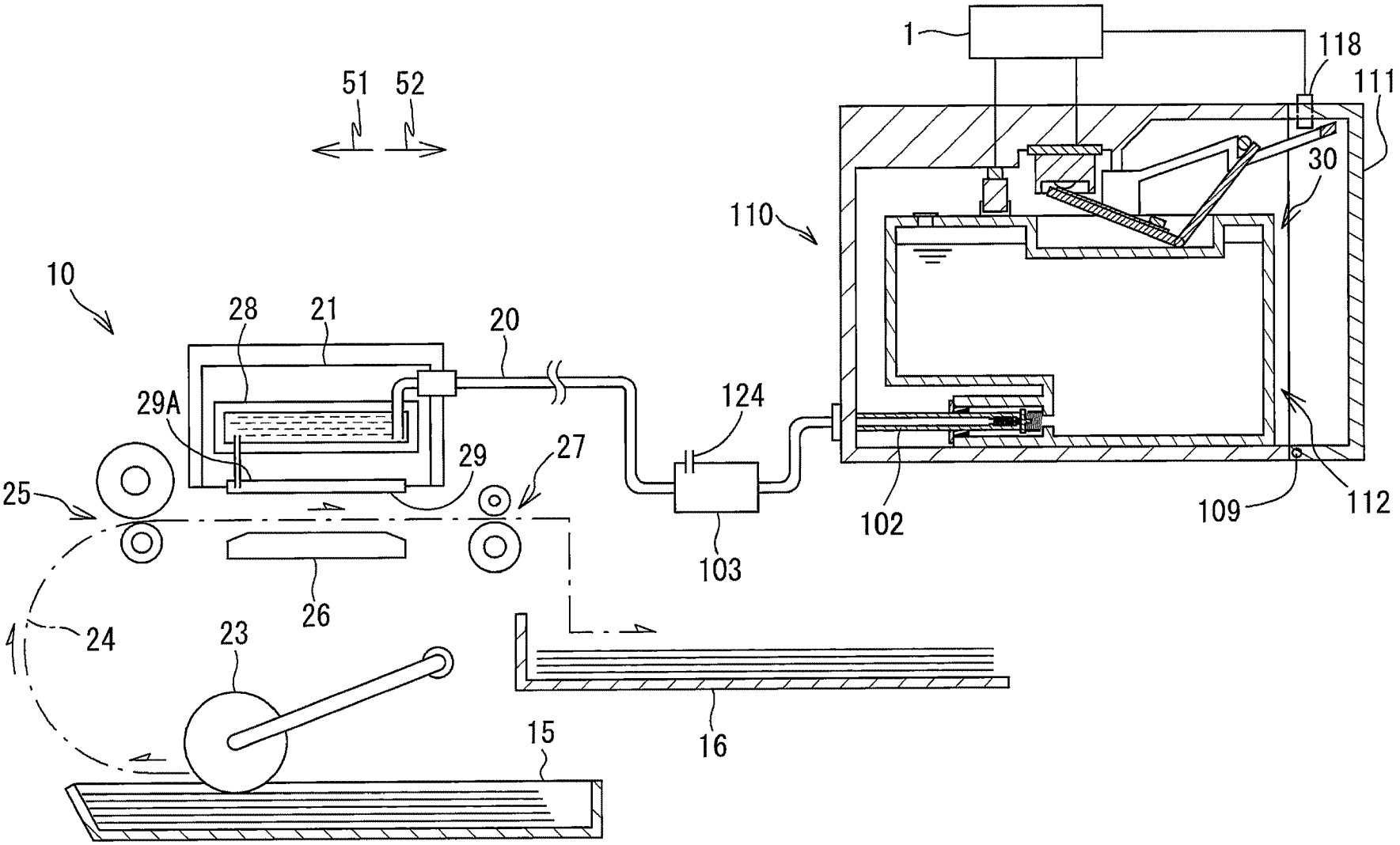
FIG. 1 is a vertical cross-sectional diagram schematically illustrating an internal structure of a printer according to an embodiment of the present disclosure.

As illustrated in FIG. 1, a printer 10 according to the embodiment is configured to record images on sheets of paper according to an inkjet recording method of ejecting ink droplets toward the sheets. The printer 10 includes a recording head 21, a cartridge-attachment portion 110, and ink tubes 20. Ink cartridges 30 storing ink to be supplied to the recording head 21 are detachably attachable to the cartridge-attachment portion 110. The ink tubes 20 connect the recording head 21 to the cartridge-attachment portion 110. An opening 112 is formed in one end of the cartridge-attachment portion 110. The ink cartridge 30 and the printer 10 constitute a system of the present disclosure.

Figure 9:
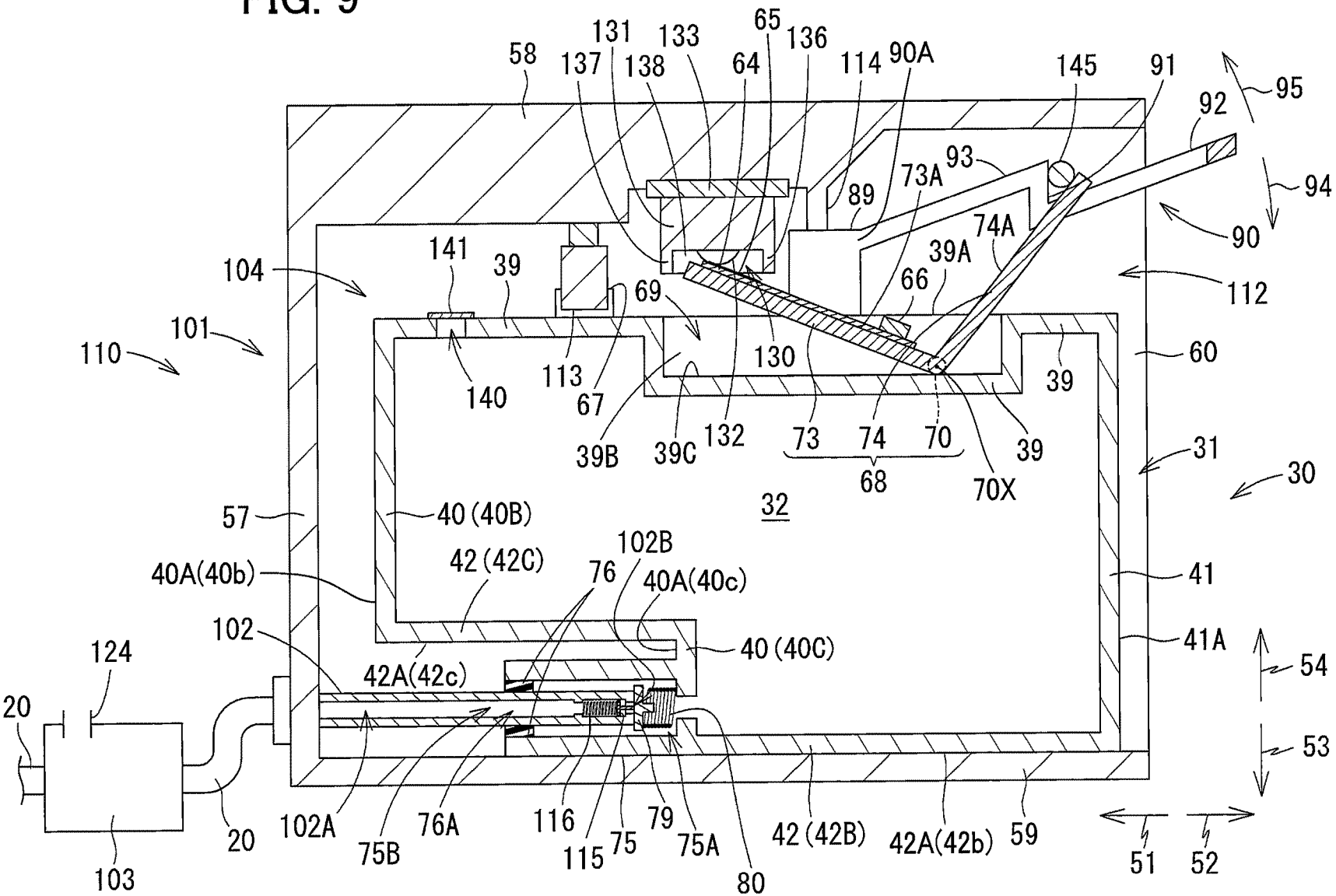
FIG. 9 is a vertical cross-sectional view of the ink cartridge according to the embodiment attached to the cartridge-attachment portion.

The ink cartridges 30 are inserted into the cartridge-attachment portion 110 through the opening 112 in order to be attached to the cartridge-attachment portion 110. The ink cartridges 30 are also extracted from the cartridge-attachment portion 110 through the opening 112. FIG. 1 illustrates one of the ink cartridges 30 in its attached state in the cartridge-attachment portion 110, i.e., when the ink cartridge 30 has been completely attached to the cartridge-attachment portion 110. FIG. 9 illustrates the ink cartridge 30 and cartridge-attachment portion 110 of FIG. 1. That is, FIG. 9 illustrates the attached state of the ink cartridge 30.

In the following description, as illustrated in FIG. 9, a frontward direction 51 is defined as a direction in which the ink cartridge 30 is inserted into the cartridge-attachment portion 110. Further, a posture of the ink cartridge 30 when being inserted forward into and attached to the cartridge-attachment portion 110 is defined as an upright posture. Hence, when in its attached state, the ink cartridge 30 is in the upright posture. FIGS. 1 and 4 through 11 illustrate the ink cartridge 30 in this upright posture. A rearward direction 52 is defined as a direction opposite the frontward direction 51, and is a direction in which the ink cartridge 30 is extracted from the cartridge attachment portion 110. In the present embodiment, a horizontal direction is defined as a direction orthogonal to the direction of gravity and parallel to the insertion direction. Both the frontward direction 51 and rearward direction 52 are parallel to the horizontal direction (direction orthogonal to the direction of gravity). The frontward direction 51 and rearward direction 52 intersect the direction of gravity. Further, a downward direction 53 is defined as the direction of gravity, and an upward direction 54 is defined as a direction opposite the direction of gravity. As illustrated in FIGS. 5A and 5B, a rightward direction 55 and a leftward direction 56 are defined as directions orthogonal to the frontward direction 51 and downward direction 53. More specifically, when the ink cartridge 30 is in its upright posture (the attached state illustrated in FIG. 1), the rightward direction 55 is defined as a direction extending rightward and the leftward direction 56 as a direction extending leftward when the ink cartridge 30 is viewed from the rear, as illustrated in FIG. 5B.

Further, in the following description, the frontward direction 51 and rearward direction 52 are collectively referred to as a front-rear direction, the upward direction 54 and downward direction 53 are collectively referred to as a vertical direction, and the rightward direction 55 and leftward direction 56 are collectively referred to as a left-right direction.

In the state where the ink cartridge 30 is completely attached to the cartridge-attachment portion 110, the ink cartridge 30 has a height in the vertical direction; a depth in the front-rear direction (i.e., insertion direction); and a width in the left-right direction (i.e., widthwise direction).

When the ink cartridge 30 is in its upright posture, the width direction of the ink cartridge 30 corresponds to the left-right direction, the height direction of the ink cartridge 30 corresponds to the vertical direction, and the depth direction of the ink cartridge 30 corresponds to the front-rear direction.

While in its upright posture, the ink cartridge 30 is inserted forward into the cartridge-attachment portion 110 through the opening 112 (see FIGS. 7 and 8) until the ink cartridge 30 is mounted in the cartridge-attachment portion 110 (see FIG. 9). The ink cartridge 30 is also extracted rearward from the cartridge-attachment portion 110 while in its upright posture.

The ink cartridge 30 stores ink that the printer 10 can use for printing. As illustrated in FIG. 1, the ink cartridge 30 is connected to the recording head 21 by the ink tube 20 when the ink cartridge 30 is in its attached state in the cartridge-attachment portion 110. The recording head 21 includes sub-tanks 28, and nozzles 29. Each of the sub-tanks 28 temporarily holds ink to be supplied through the corresponding ink tube 20. The recording head 21 ejects ink supplied from the sub-tanks 28 through the nozzles 29 according to an inkjet recording method. More specifically, the recording head 21 includes a head control board (not illustrated), and piezoelectric elements 29A corresponding one-on-one to the nozzles 29. The head control board selectively applies drive voltages to the piezoelectric elements 29A in order to eject ink from the nozzles 29.

The printer 10 also includes a sheet tray 15, a feed roller 23, a conveying path 24, a pair of conveying rollers 25, a platen 26, a pair of discharge rollers 27, and a discharge tray 16. The feed roller 23 feeds each of the sheets from the sheet tray 15 onto the conveying path 24, and the conveying rollers 25 convey the sheet over the platen 26. The recording head 21 ejects ink onto the sheet as the sheet passes over the platen 26, whereby an image is recorded on the sheet. The discharge rollers 27 receive the sheet that has passed over the platen 26 and discharge the sheet into the discharge tray 16 provided on the downstream end of the conveying path 24.

<Cartridge-Attachment Portion 110>

Figure 2:
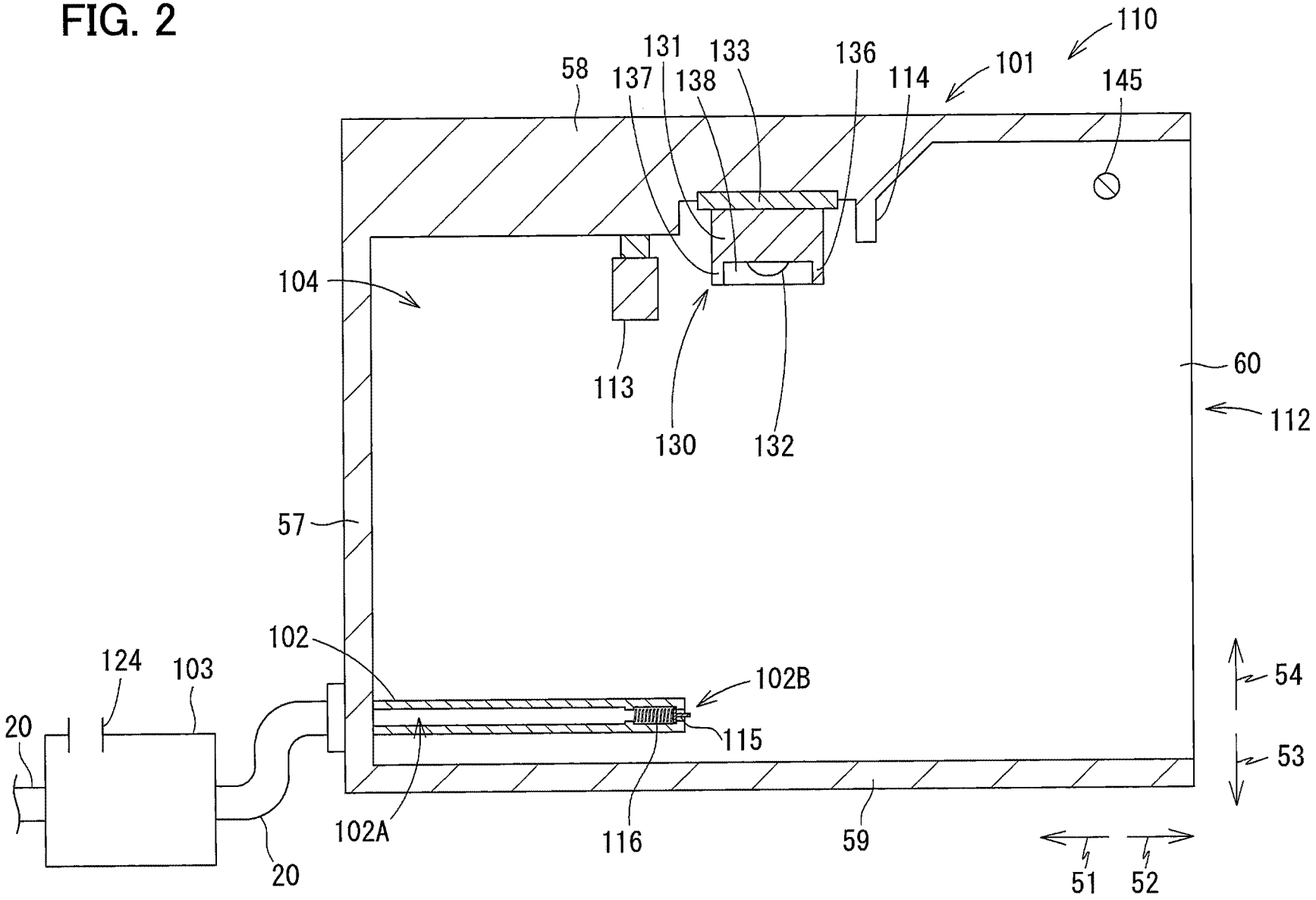
FIG. 2 is a vertical cross-sectional view of a cartridge-attachment portion according to the embodiment.

As illustrated in FIG. 2, the cartridge-attachment portion 110 includes a cartridge holder 101, tubes 102, a shaft 145, tanks 103, optical sensors 113, protruding part 114, and connectors 130.

<Cartridge Holder 101>

The cartridge holder 101 illustrated in FIG. 2 constitutes a casing of the cartridge-attachment portion 110. The cartridge holder 101 has a box shape. An interior space 104 is formed inside the cartridge holder 101.

As illustrated in FIG. 2, the cartridge holder 101 is provided with an end wall 57, a bottom wall 59, a top wall 58, and a pair of side walls 60. The bottom wall 59 extends rearward from the bottom edge of the end wall 57. The top wall 58 extends rearward from the top edge of the end wall 57 and is separated vertically from the bottom wall 59. The side walls 60 extend rearward from respective right and left edges of the end wall 57. The side wall 60 extending from the right edge of the end wall 57 is connected to right edges of the bottom wall 59 and top wall 58, while the side wall 60 extending from the left edge of the end wall 57 is connected to left edges of the bottom wall 59 and top wall 58. Hence, the side walls 60 connect the top wall 58 to the bottom wall 59.

The opening 112 is formed in the rear end of the cartridge holder 101 to oppose the end wall 57 in the front-rear direction. The opening 112 is in communication with the interior space 104 of the cartridge holder 101. A user faces the opening 112 when using the printer 10.

The interior space 104 of the cartridge holder 101 is defined by the end wall 57, bottom wall 59, top wall 58, and side walls 60. Partitioning walls (not illustrated) partition the interior space 104 into four compartments. One each of the tubes 102, tanks 103, optical sensors 113, protruding parts 114, and connector 130 is provided in each compartment of the partitioned interior space 104. Note that the number of compartments in the interior space 104 is not limited to four.

<Tubes 102>

The tube 102 illustrated in FIG. 2 is a cylindrically shaped member formed of a resin. As illustrated in FIG. 2, the tubes 102 are located in a lower portion of the end wall 57 constituting the cartridge holder 101. The tubes 102 protrude farther rearward than the end wall 57 of the cartridge holder 101. A rear end (distal end) and a front end (proximal end) of each tube 102 are both open.

The tube 102 has an interior space 102A. A valve 115 and a coil spring 116 are accommodated in the interior space 102A. By moving in the front-rear direction, the valve 115 opens and closes an opening 102B formed in the distal end of the tube 102. The coil spring 116 urges the valve 115 rearward. Hence, when an external force is not being applied to the valve 115 (when the ink cartridge 30 is not mounted in the cartridge-attachment portion 110), the valve 115 closes the opening 102B. Further, when an external force is not being applied to the valve 115, a rear end of the valve 115 urged by the coil spring 116 protrudes rearward from the opening 102B.

Notches (not illustrated) are formed in a peripheral wall of the tube 102 at the distal end thereof, and specifically in a portion of the peripheral wall positioned rearward from a part of the valve 115 that closes the opening 102B, i.e., a front end of the valve 115.

<Shaft 145>

As illustrated in FIG. 2, the shaft 145 extends in the left-right direction near the top wall 58 of the cartridge holder 101 and near the opening 112. The shaft 145 is a rod-shaped member that extends in the left-right direction through the interior space 104 of the cartridge holder 101. The shaft 145 is a metal rod, for example. Left and right ends of the shaft 145 are fixed to the side walls 60 of the cartridge holder 101.

<Cover 111>

As illustrated in FIG. 1, the cover 111 is provided near the opening 112 formed in the cartridge holder 101. The cover 111 is capable of covering the opening 112 or exposing the opening 112 to the outside by closing and opening on the cartridge holder 101. The cover 111 is supported on a pivot shaft 109 that extends in the left-right direction near a portion of the cartridge holder 101 defining a bottom edge of the opening 112. With this construction, the cover 111 is capable of pivoting from a closed position (see FIG. 1) for covering the opening 112 to an open position so that a top edge of the cover 111 moves forward. When the cover 111 is in the open position, the user can insert ink cartridges 30 into the cartridge holder 101 through the opening 112 formed in the cartridge holder 101. When the cover 111 is in the closed position, the user cannot insert ink cartridges 30 into or extract ink cartridges 30 from the cartridge holder 101.

<Tanks 103>

As illustrated in FIG. 2, the tanks 103 are provided frontward of the cartridge holder 101. Each tank 103 has a top portion that is open to the outside through an air communication port 124. Accordingly, the interior of the tank 103 is open to the atmosphere. The interior space in the tank 103 is in communication with the front end of the corresponding tube 102 via the corresponding ink tube 20. With this arrangement, ink flowing out of the interior space 102A of the tube 102 is accumulated in the tank 103. The interior space of the tank 103 is also in communication with the recording head 21 via the corresponding ink tube 20. Accordingly, ink stored in the interior of the tank 103 is supplied to the recording head 21 through the corresponding ink tube 20.

Note that the cartridge-attachment portion 110 need not be provided with the tanks 103. In this case, the front ends of the tubes 102 communicate with the recording head 21 via the ink tubes 20 without passing through the tanks 103.

<Optical Sensors 113>

As illustrated in FIG. 2, the optical sensors 113 are disposed near the top wall 58 of the cartridge holder 101. The optical sensors 113 are positioned farther forward than the shaft 145 in the front-rear direction. Each optical sensor 113 includes a light-emitting part and a light receiving part. The light-emitting part is disposed on the right or left of the light-receiving part with a gap formed therebetween. The light-emitting part is configured to emit light toward the light-receiving part in the left-right direction.

The optical sensors 113 are configured to output detection signals to a controller 1 (see FIG. 1). The signals differ according to whether the corresponding light-receiving part receives light emitted from the corresponding light-emitting part. For example, the optical sensor 113 outputs a low level signal to the controller 1 when the light-receiving part cannot receive light emitted from the light-emitting part (that is, when the received light is less than a prescribed intensity) and outputs a high level signal to the controller 1 when the light-receiving part can receive light emitted from the light-emitting part (that is, when the received light is greater than or equal to the prescribed intensity). Here, the controller 1 is a device for controlling operations of the printer 10 and is configured of a CPU, a ROM, and a RAM, for example.

<Cover Sensor 118>

The cover sensor 118 is disposed on the cartridge holder 101 near the top edge of the opening 112. The cover sensor 118 includes a light-emitting part and a light-receiving part. When the cover 111 is in the closed position, a part of the cover 111 is disposed in an optical path of the light traveling from the light-emitting part toward the light-receiving part, blocking the light from reaching the light-receiving part in the cover sensor 118. Accordingly, the cover sensor 118 outputs a low level signal to the controller 1. When the cover 111 is not in the closed position, that is, when the cover 111 is in a position separated from the cover sensor 118, the cover 111 does not interrupt light traveling from the light-emitting part to the light-receiving part, and the cover sensor 118 outputs a high level signal to the controller 1.

<Protruding Parts 114>

As illustrated in FIG. 2, the protruding parts 114 protrude downward from the top wall 58 of the cartridge holder 101. The protruding parts 114 are disposed rearward of the corresponding optical sensors 113 and forward of the shaft 145 in the front-rear direction.

<Connectors 130>

Figure 3A:
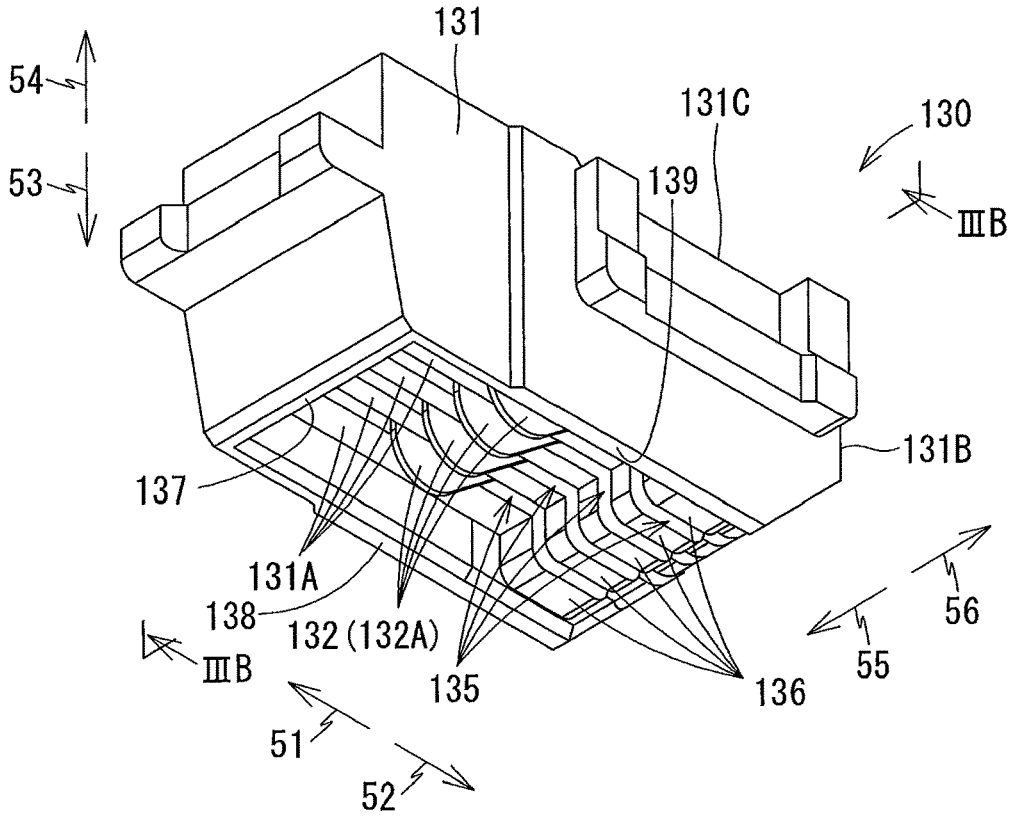
FIG. 3A is a perspective view of a connector of the cartridge-attachment portion according to the embodiment.
Figure 3B:
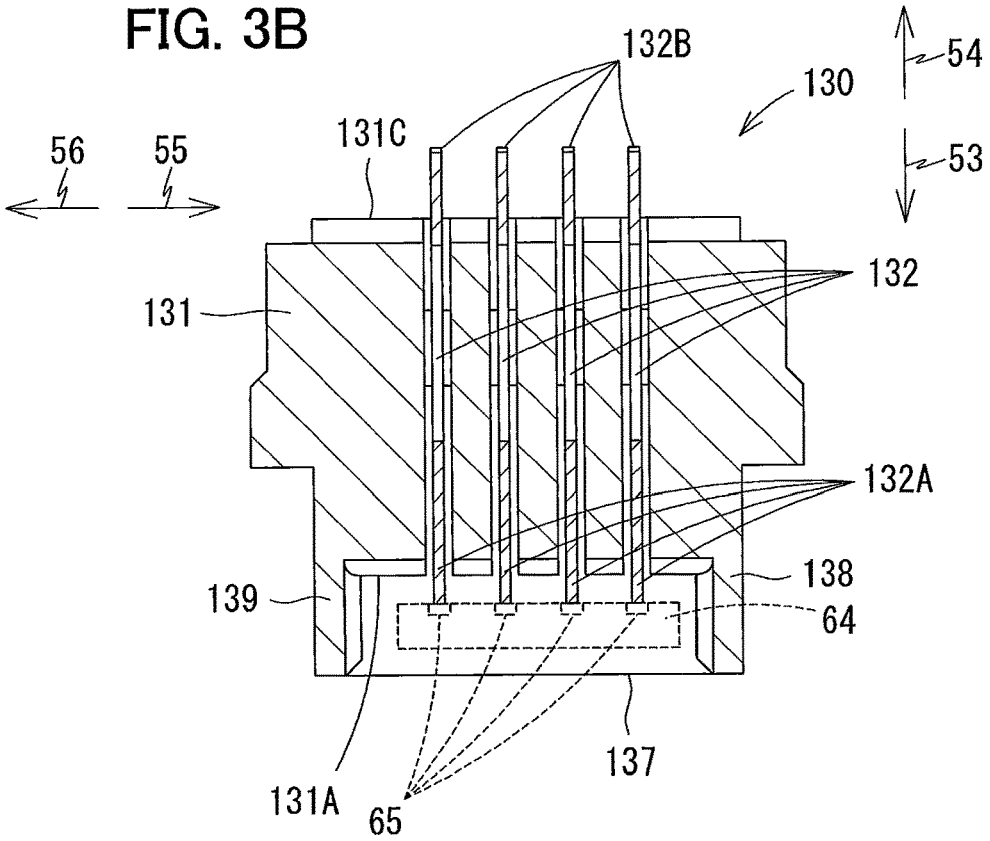
FIG. 3B is a cross-sectional view of the connector of the cartridge-attachment portion according to the embodiment taken along a plane IIIB-IIIB illustrated in FIG. 3A.

As illustrated in FIGS. 2, 3A and 3B, each of the connectors 130 includes contacts 132, and a case 131 accommodating the contacts 132.

As illustrated in FIG. 2, a circuit board 133 is fixed to the cartridge holder 101 in proximity to the top wall 58. The circuit board 133 is positioned farter rearward than the tubes 102 and optical sensors 113 and farther forward than the shaft 145 and protruding parts 114. The circuit board 133 is fixed to the cartridge holder 101. The cases 131 of the connectors 130 are fixed to a bottom surface of the circuit board 133 with screws, solder, or the like (not illustrated). Hence, the connectors 130 are fixed to the cartridge holder 101 via the circuit board 133. Note that the connectors 130 need not be fixed to the cartridge holder 101. For example, the connectors 130 may be removably fitted into or otherwise attached to the bottom surface of the circuit board 133.

As illustrated in FIGS. 3A and 3B, the case 131 of each connector 130 has a general rectangular parallelepiped shape. Slots 135 are formed in the case 131 from a bottom surface 131A to a top surface 131C. The slots 135 also pass through a rear surface 131B of the case 131. Four of the slots 135 are formed at intervals in the left-right direction. The four slots 135 provide four internal spaces in the case 131. A single contact 132 is disposed in each of the four internal spaces. Thus, the connector 130 includes four contacts 132. Note that the number of slots 135 is not limited to four. That is, the number of contacts 132 provided in the connector 130 is not limited to four.

The case 131 supports the contacts 132 in the corresponding internal spaces formed by the slots 135. The contacts 132 are configured of members that are flexible and electrically conductive. Bottom ends 132A of the contacts 132 protrude farther downward than the bottom surface 131A of the case 131. The bottom ends 132A of the contacts 132 can be elastically deformed upward.

Top ends 132B of the contacts 132 (see FIG. 3B) are mounted on the circuit board 133. Through this construction, the contacts 132 are electrically connected to an electric circuit mounted on the same circuit board 133. In other words, electricity can be conducted between the contacts 132 and the electric circuit. This electric circuit is also electrically connected to the controller 1 (see FIG. 1).

The case 131 also includes a rear wall 136, a front wall 137, a right wall 138, and a left wall 139. The rear wall 136, front wall 137, right wall 138, and left wall 139 protrude downward from the bottom surface 131A of the case 131. Bottom edges of the rear wall 136, front wall 137, right wall 138, and left wall 139 are thus positioned lower than bottom edges of the contacts 132.

The rear wall 136 is positioned farther rearward than the bottom ends 132A of the contacts 132. The front wall 137 is positioned farther forward than the bottom ends 132A of the contacts 132. The right wall 138 is positioned farther rightward than the bottom ends 132A of the contacts 132, and the left wall 139 is positioned farther leftward than the bottom ends 132A of the contacts 132. The right wall 138 and left wall 139 are aligned with each other in the left-right direction. A front edge of the right wall 138 is connected to a right edge of the front wall 137, and a rear edge of the right wall 138 is connected to a right edge of the rear wall 136. A front edge of the left wall 139 is connected to a left edge of the front wall 137, and a rear edge of the left wall 139 is connected to a left edge of the rear wall 136.

<Ink Cartridge 30>

Figure 4:
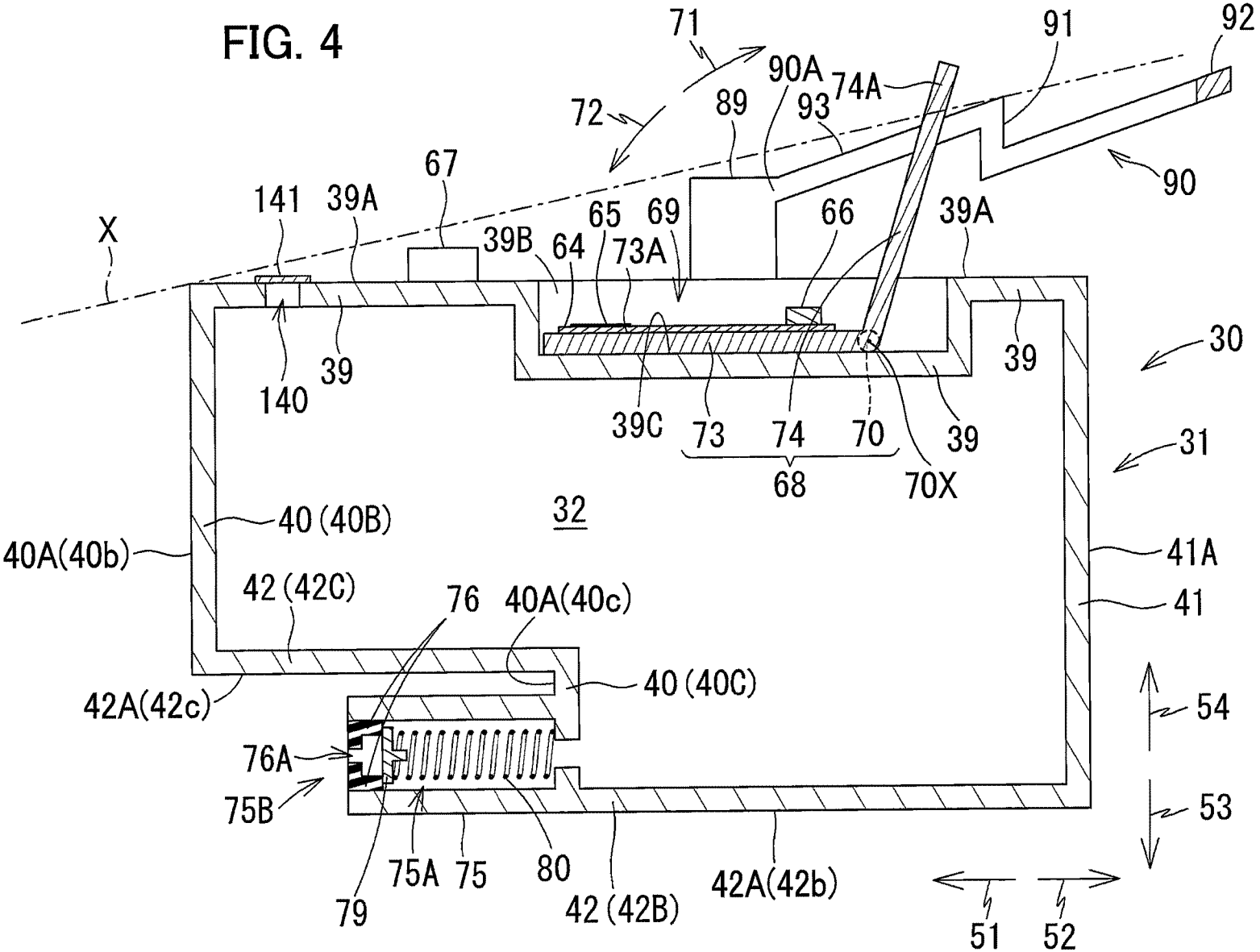
FIG. 4 is a vertical cross-sectional view of an ink cartridge according to the embodiment in an upright posture.
Figure 5B:
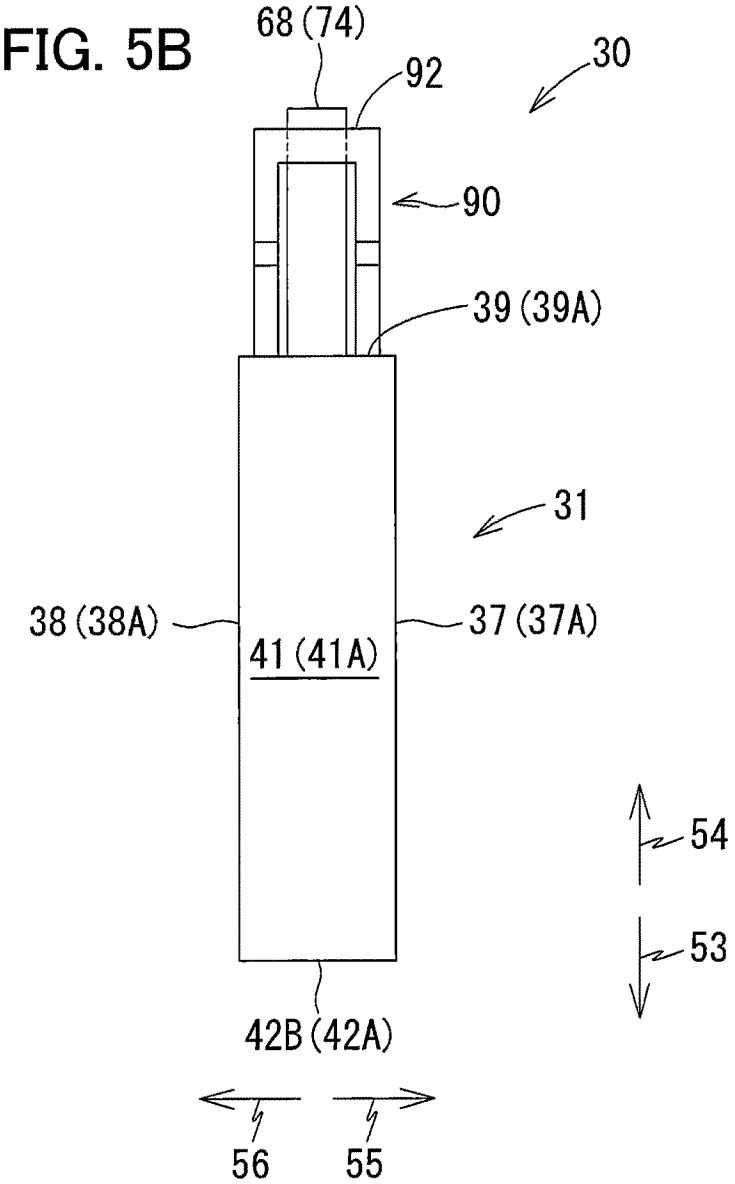
FIG. 5B is a rear side view of the ink cartridge according to the embodiment in the upright posture.
Figure 5A:
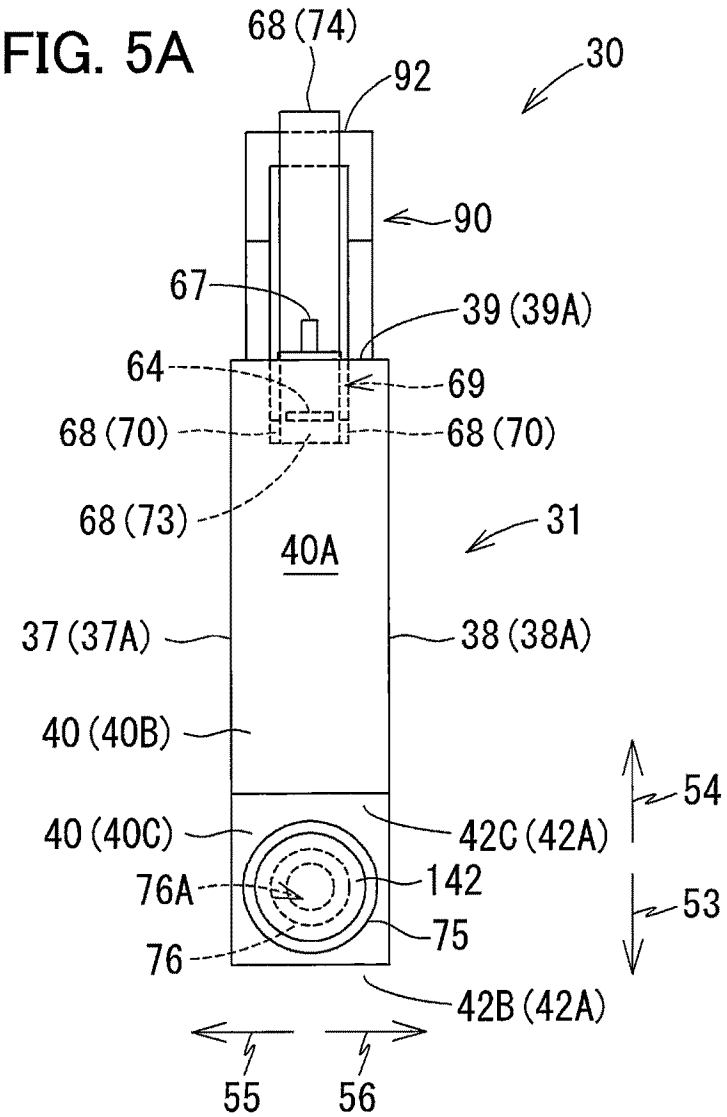
FIG. 5A is a front side view of the ink cartridge according to the embodiment in the upright posture.
Figure 6:
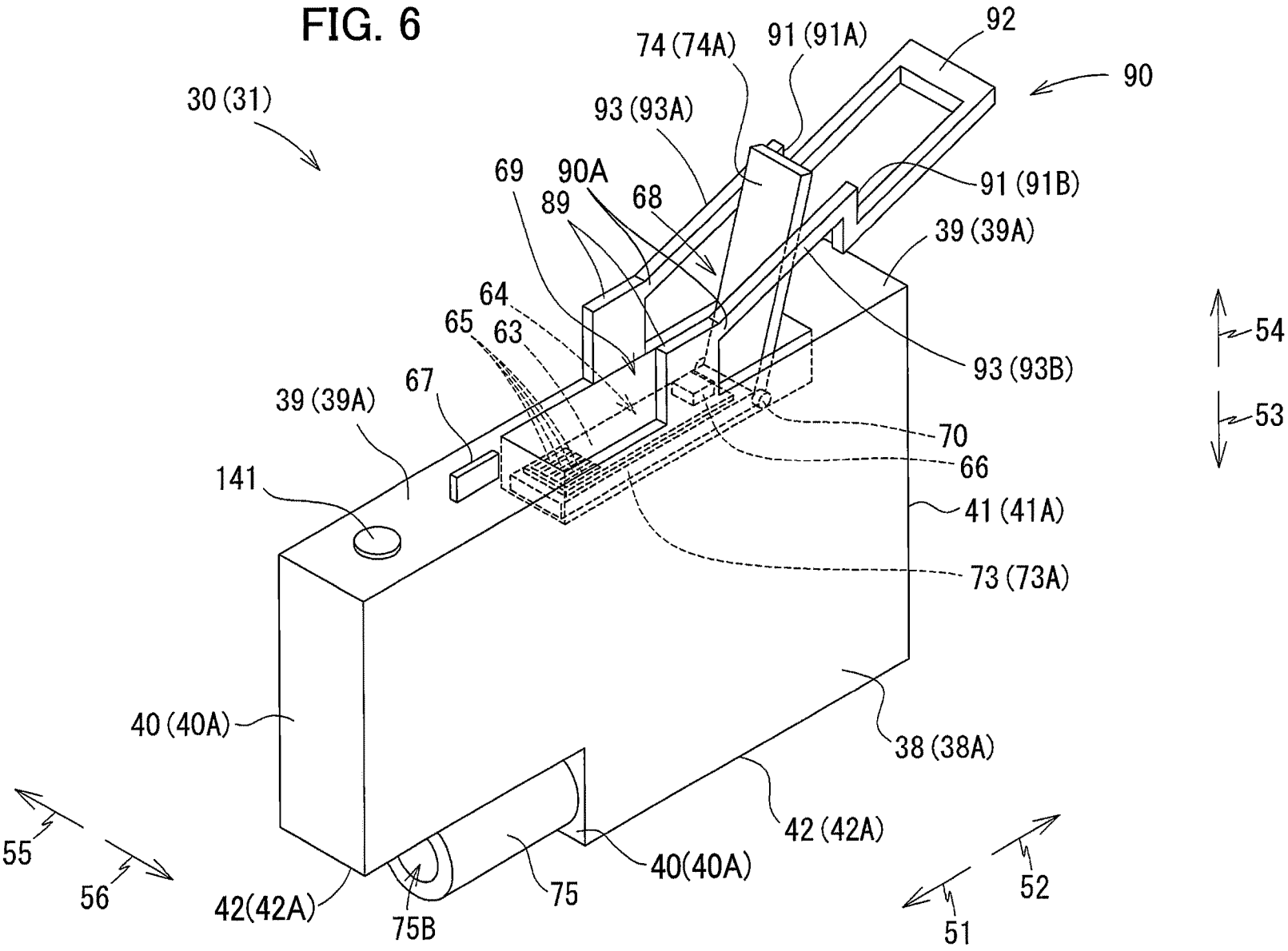
FIG. 6 is a perspective view of the ink cartridge according to the embodiment.

The ink cartridge 30 illustrated in FIGS. 4 to 6 is a container that stores ink. One ink cartridge 30 is accommodated in each of the four compartments partitioned in the interior space 104 of the cartridge holder 101 (see FIG. 2). Thus, four ink cartridges 30 can be accommodated in the cartridge-attachment portion 110 in the present embodiment. Each of the four ink cartridges 30 corresponds to one of the ink colors cyan, magenta, yellow, and black. Ink in one of these colors is stored in the corresponding ink cartridge 30. Note that the number of ink cartridges 30 that the cartridge-attachment portion 110 can accommodate is not limited to four.

As illustrated in FIGS. 4 to 6, the ink cartridge 30 includes a housing 31, a sealing member 76, a locking lever 90, a projection 67, a lever 68, and a circuit board 64.

<Housing 31>

The housing 31 is configured of a front wall 40, a rear wall 41, a top wall 39, a bottom wall 42, and a pair of side walls 37 and 38. The front wall 40 and rear wall 41 are separated from each other in the front-rear direction. The top wall 39 is arranged between the front wall 40 and rear wall 41 and extends from a top edge of the front wall 40 to a top edge of the rear wall 41. The bottom wall 42 is arranged between the front wall 40 and rear wall 41 and extends from a bottom edge of the front wall 40 to a bottom edge of the rear wall 41. The top wall 39 and bottom wall 42 are separated from each other in the direction of gravity. The side wall 37 and side wall 38 are separated from each other in the left-right direction. Peripheral edges of the side walls 37 and 38 are connected to the front wall 40, rear wall 41, top wall 39, and bottom wall 42.

In a state where the ink cartridge 30 is in its upright posture, a direction from the rear wall 41 to the front wall 40 is equivalent to the frontward direction 51, a direction from the front wall 40 to the rear wall 41 is equivalent to the rearward direction 52, a direction from the top wall 39 to the bottom wall 42 is equivalent to the downward direction 53, a direction from the bottom wall 42 to the top wall 39 is equivalent to the upward direction 54, a direction from the side wall 38 to the side wall 37 is equivalent to the rightward direction 55, and a direction from the side wall 37 to the side wall 38 is equivalent to the leftward direction 56. Also in this upright posture, a front surface 40A of the front wall 40 faces forward, a rear surface 41A of the rear wall 41 faces rearward, a bottom surface 42A of the bottom wall 42 faces downward, a top surface 39A of the top wall 39 faces upward, a right surface 37A of the side wall 37 faces rightward, and a left surface 38A of the side wall 38 faces leftward.

The front wall 40 is configured of a front wall 40B, and a front wall 40C positioned farther rearward than the front wall 40B. That is, a front surface 40*b* of the front wall 40B and a front surface 40*c* of the front wall 40C constitute the front surface 40A of the front wall 40. The bottom wall 42 is configured of a bottom wall 42B, and a bottom wall 42C positioned higher than the bottom wall 42B. A bottom surface 42*b* of the bottom wall 42B and a bottom surface 42*c* of the bottom wall 42C constitute the bottom surface 42A of the bottom wall 42. The bottom wall 42C extends continuously rearward from a bottom edge of the front wall 40B. The bottom wall 42B and bottom wall 42C are joined through the front wall 40C.

Unless otherwise specified, it will be assumed that the ink cartridge 30 is in its upright posture in the following description. In other words, the vertical, front-rear, and left-right directions for the ink cartridge 30 are defined on the basis of the ink cartridge 30 being in the upright posture.

The ink cartridge 30 has an overall flattened shape in which a left-right dimension thereof is smaller than a front-rear dimension thereof, and the vertical and front-rear dimensions are larger than the left-right dimension.

The ink cartridge 30 is mounted in the cartridge holder 101 by inserting the ink cartridge 30 forward through the opening 112 formed in the cartridge holder 101 of the cartridge-attachment portion 110 and is removed from the cartridge holder 101 by pulling the ink cartridge 30 rearward through the opening 112.

As illustrated in FIG. 4, the housing 31 defines therein a storage chamber 32 for storing ink. The storage chamber 32 is formed between the front wall 40 and rear wall 41, between the top wall 39 and bottom wall 42, and between the pair of side walls 37 and 38. In the present embodiment, the storage chamber 32 is defined by a surface of the front wall 40 opposite the front surface 40A (rear surface of the front wall 40), a surface of the rear wall 41 opposite the rear surface 41A (front surface of the rear wall 41), a surface of the top wall 39 opposite the top surface 39A (lower surface of the top wall 39), and a surface of the bottom wall 42 opposite the bottom surface 42A (upper surface of the bottom wall 42).

In the housing 31, at least the rear wall 41 has a light-transmission capability so that a level of ink stored in the storage chamber 32 is visible from the outside.

The housing 31 includes the cylinder 75 that protrudes forward from the front surface 40*c* of the front wall 40C. The cylinder 75 is elongated in the front-rear direction. A passage 75A extending in the front-rear direction is formed inside the cylinder 75. That is, the direction in which the cylinder 75 and passage 75A extend (front-rear direction) is aligned with the insertion direction of the ink cartridge 30. An opening 75B is formed in a front end of the cylinder 75 and in communication with the passage 75A. The passage 75A has a rear end in communication with the storage chamber 32. That is, the passage 75A is open at its rear end on the front surface 40*c* of the front wall 40C. In other words, the passage 75A is open frontward at the front wall 40. Hence, the passage 75A penetrates the front wall 40.

The passage 75A accommodates a valve 79, and a coil spring 80. The valve 79 opens and closes the opening 75B by moving in the front-rear direction. The coil spring 80 urges the valve 79 frontward. Therefore, when an external force is not applied to the valve 79, the valve 79 firmly contacts the sealing member 76 fitted in the opening 75B. However, when an external force is applied to the valve 79, the valve 79 separates from the sealing member 76, allowing ink stored in the storage chamber 32 to be supplied through the passage 75A and out through the opening 75B in the cylinder 75. Note that a structure for switching opening and closing of the opening 75B is not limited to the structure configured of the valve 79. For example, the opening 75B may be closed by a seal adhered to the cylinder 75.

An air communication port 140 is formed in the top wall 39 of the housing 31. A seal 141 seals the air communication port 140 prior to the ink cartridge 30 being inserted into the cartridge-attachment portion 110. The seal 141 can be peeled off the air communication port 140. By peeling the seal 141 off the air communication port 140 before inserting the ink cartridge 30 into the cartridge-attachment portion 110, the storage chamber 32 is able to communicate with the external air via the air communication port 140. Note that communication between the storage chamber 32 and external air may be achieved through means not involving peeling off the seal 141. For example, a valve may be provided in the air communication port 140, and the valve may be used to switch communication between the storage chamber 32 and the outside air on and off.

The front wall 40, rear wall 41, top wall 39, bottom wall 42, and side walls 37 and 38 may be configured of a plurality of walls in the same manner as the front wall 40 in the embodiment, or may be configured of single walls in the manner of the rear wall 41.

Further, the surfaces of the ink cartridge 30 including the front surface 40A of the front wall 40, rear surface 41A of the rear wall 41, top surface 39A of the top wall 39, bottom surface 42A of the bottom wall 42, right surface 37A of the side wall 37, and left surface 38A of the side wall 38 need not be formed as single flat surfaces.

The front surface 40A of the front wall 40 is a surface of the housing 31 that is visible when viewing the ink cartridge 30 in its upright posture from the front side. According to a concept of the present disclosure, a front surface includes: a surface of the housing 31 positioned farthest forward (the front surface 40*b*); and a surface of the housing 31 positioned forward of a halfway point in the front-rear direction between the forwardmost surface and a rearmost surface of the housing 31 (the front surface 40*c*).

The rear surface 41A of the rear wall 41 is a surface of the housing 31 that is visible when viewing the ink cartridge 30 in its upright posture from the rear side. The concept of a rear surface in the present disclosure includes: a surface of the housing 31 positioned farthest rearward (the rear surface 41A); and a surface positioned rearward of the halfway point in the front-rear direction between the rearmost surface and the forwardmost surface of the housing 31.

The top surface 39A of the top wall 39 is a surface of the housing 31 that is visible when viewing the ink cartridge 30 in its upright posture from above. The concept of the top surface in the present disclosure includes: a topmost surface of the housing 31 (the top surface 39A); and a surface above a vertical halfway point between this topmost surface and a bottommost surface of the housing 31 (in the present embodiment, a bottom surface 39C of a recessed part 69 described later).

The bottom surface 42A of the bottom wall 42 is a surface of the housing 31 that is visible when viewing the ink cartridge 30 in its upright posture from below. The concept of the bottom surface in the present disclosure includes: the bottommost surface of the housing 31 (the bottom surface 42*b*); and a surface below the vertical halfway point between this bottommost surface and the topmost surface of the housing 31 (the bottom surface 42*c*).

The right surface 37A of the side wall 37 is a surface of the housing 31 that is visible when viewing the ink cartridge 30 in its upright posture from the right side.

The left surface 38A of the side wall 38 is a surface of the housing 31 that is visible when viewing the ink cartridge 30 in its upright posture from the left side.

<Sealing Member 76>

The sealing member 76 illustrated in FIGS. 4 and 5A is configured of an elastic member formed of rubber or the like. The sealing member 76 is a ring-shaped member with a circular through-hole 76A formed in a center thereof. The through-hole 76A has a diameter smaller than an outer diameter of the tube 102 in the cartridge-attachment portion 110 (see FIG. 2). As illustrated in FIG. 4, the sealing member 76 is disposed near the opening 75B of the passage 75A of the cylinder 75 so that the through-hole 76A is at the same position as the opening 75B in the front-rear direction. The sealing member 76 has an outer diameter larger than a diameter of the opening 75B. Accordingly, when the sealing member 76 is fitted into the opening 75B, a hermetic seal is formed between the sealing member 76 and the cylinder 75 to provide a light-tight seal therebetween.

The sealing member 76 is prevented from coming out of the cylinder 75 by well-known means. For example, the sealing member 76 may be fixed in the cylinder 75 by interposing the sealing member 76 between the cylinder 75 and a cap (not illustrated) placed over the cylinder 75, or may be fixed in the cylinder 75 by adhesive.

<Locking Lever 90>

As illustrated in FIGS. 4 and 6, a recessed part 69 is formed in the top wall 39. The recessed part 69 is recessed downward from the top surface 39A. Protruding parts 89 protrude upward from the top wall 39 at positions on the top surface 39A to the right and left of the recessed part 69. The locking lever 90 is provided on the top portions of the protruding parts 89. The locking lever 90 extends diagonally upward and rearward from the top portions of the protruding parts 89. The locking lever 90 is provided with a contact surface 93, an engaging surface 91, and an operating part 92. The contact surface 93 is a surface extending upward and rearward from a proximal end 90A of the locking lever 90 which is a connecting portion between the protruding part 89 and locking lever 90. The engaging surface 91 is a surface that extends vertically at a position in the front-rear center of the locking lever 90. The contact surface 93 and engaging surface 91, i.e., the portion of the locking lever 90 nearest the proximal end 90A, are each formed in two locations, and specifically on the right and left of the recessed part 69. Hence, the locking lever 90 is provided with two contact surfaces 93A and 93B, and two engaging surfaces 91A and 91B, as illustrated in FIG. 6. The operating part 92 is provided on the rear end of the locking lever 90 at a position rearward of the engaging surface 91. The portions of the locking lever 90 protruding from right and left sides of the recessed part 69 formed in the top surface 39A become joined at the operating part 92, i.e., at the distal end of the locking lever 90. The rear end of the operating part 92 is farther rearward than the rear wall 41 of the housing 31.

By pushing the operating part 92 downward, the user can elastically deform the locking lever 90 in a direction indicated by an arrow 94 (see FIG. 7) about the parts of the locking lever 90 that are connected to the protruding part 89, i.e., the proximal ends 90A of the locking lever 90. Note that the locking lever 90 may also be configured to extend directly from the top surface 39A of the top wall 39.

<Projection 67>

As illustrated in FIG. 4, the projection 67 is provided on the top surface 39A of the top wall 39. The projection 67 protrudes upward from the top surface 39A and is elongated in the front-rear direction. The projection 67 is positioned forward of the recessed part 69. When viewed in the left-right direction, the projection 67 is positioned lower than a virtual plane X that is the highest among virtual planes passing through the upper-front corner of the housing 31 and the locking lever 90.

Light emitted by the optical sensor 113 of the cartridge-attachment portion 110 (see FIG. 2) is incident on either a right surface or a left surface of the projection 67. The surface of the projection 67 on which light is incident may be called a light-blocking surface serving as a light-blocking part. In the present embodiment, the projection 67 is a plate formed of a resin material that contains a color material (black pigment) capable of blocking or attenuating light, for example. As a variation, a material that prevents the passage of light such as aluminum foil may be affixed to at least the light-blocking surface of the projection 67.

<Lever 68>

As illustrated in FIGS. 4 and 6, the lever 68 is arranged in the recessed part 69. That is, with respect to the left-right direction, the lever 68 is provided between the contact surfaces 93A and 93B formed at two locations on the locking lever 90 and between the engaging surfaces 91A and 91B formed at two locations on the locking lever 90 (see FIG. 6). Also, with respect to the vertical direction, the lever 68 is positioned closer to the top surface 39A of the housing 31 than to the bottom surface 42A of the housing 31.

The lever 68 is pivotably supported on the top wall 39 by shafts 70 and is capable of pivoting about a pivot axis 70X in directions indicated by arrows 71 and 72 in FIG. 4. The shafts 70 are formed of protrusions that protrude outward in left and right directions from the corresponding left and right surfaces of the lever 68. The pivot axis 70X is an axis of the shafts 70 and extends in the left-right directions. Here, holes (not illustrated) are formed in side surfaces 39B that constitute a portion of the top wall 39 and that define the left and right sides of the recessed part 69. The shafts 70 are inserted into these holes, whereby the lever 68 can rotate about the pivot axis 70X. Note that the structure for supporting the lever 68 in the top wall 39 is not limited to that illustrated in FIG. 4. Any of various well-known structures may be employed.

In addition to the shafts 70, the lever 68 is provided with a first arm 73, and a second arm 74. The first arm 73 has a top surface 73A, and the second arm 74 has a front surface 74A. In a state illustrated in FIG. 4, the first arm 73 extends forward from the shafts 70, and the second arm 74 extends upward from the shafts 70. When viewed along the left-right direction, smaller one of two angles formed by the first arm 73 and second arm 74 is an obtuse angle in the present embodiment.

The lever 68 is capable of pivoting between an initial orientation illustrated in FIG. 4, and a sloped orientation illustrated in FIG. 9.

When the lever 68 is in its initial orientation illustrated in FIG. 4, the first arm 73 is supported on the bottom surface 39C of the recessed part 69. The bottom surface 39C of the recessed part 69 constitutes part of the top wall 39 that defines the inner bottom of the recessed part 69.

When the lever 68 is in its initial orientation, the second arm 74 extends upward from the shafts 70. Also when the lever 68 is in the initial orientation, the top surface 73A of the first arm 73 extends in the front-rear direction and faces upward. Also when the lever 68 is in the initial orientation, the front surface 74A of the second arm 74 extends to a position higher than the contact surface 93 of the locking lever 90.

When the lever 68 is in its sloped orientation illustrated in FIG. 9, the first arm 73 slopes relative to the front-rear direction, and specifically slopes upward toward the front from the shafts 70. At this time, the distal end of the first arm 73 is separated from the bottom surface 39C. In other words, the distal end of the first arm 73 when the lever 68 is in the sloped orientation is positioned higher than the distal end of the first arm 73 when the lever 68 is in the initial orientation.

Also when the lever 68 is in the sloped orientation, the second arm 74 slopes relative to the vertical, and specifically slopes rearward toward the top from the shafts 70. Hence, the distal end of the second arm 74 when the lever 68 is in the sloped orientation is positioned farther rearward than the distal end of the second arm 74 when the lever 68 is in the initial orientation.

The first arm 73 is heavier than the second arm 74. Consequently, when no external force is applied to the lever 68, the lever 68 remains in its initial state owing to its own weight. As an alternative, the lever 68 may be urged toward its initial orientation by a coil spring or other urging member. In this case, the first arm 73 need not be heavier than the second arm 74.

<Circuit Board 64>

As illustrated in FIG. 4, the circuit board 64 is provided with a substrate 63, a memory 66, and electrodes 65. The circuit board 64 is supported from below by the first arm 73 of the lever 68. Hence, the circuit board 64 is positioned forward of the shafts 70 on the lever 68. The circuit board 64 is bonded to the top surface 73A of the first arm 73 with a photopolymer. However, the circuit board 64 may be bonded to the top surface 73A of the first arm 73 with an adhesive other than a photopolymer, or may be mounted on the top surface 73A of the first arm 73 by means other than adhesives, such as rivets.

As illustrated in FIG. 4, the circuit board 64 extends in the front-rear and left-right directions when the lever 68 is in its initial orientation. The position of the circuit board 64 at this time (i.e., the position of the circuit board 64 illustrated in FIG. 4) will be called a first position. The top surface of the circuit board 64 in the first position faces upward. Hence, the top surface of the circuit board 64 in the first position is orthogonal to the vertical. However, the top surface of the circuit board 64 need not be orthogonal to the vertical when the circuit board 64 is in the first position, but may be sloped relative to a virtual plane that is orthogonal to the vertical, for example.

When in the first position, the circuit board 64 is accommodated in the recessed part 69. That is, the circuit board 64 in the first position is positioned lower than the top surface 39A of the top wall 39.

When the lever 68 is in the sloped orientation illustrated in FIG. 9, the circuit board 64 slopes relative to the front-rear direction, and specifically slopes upward toward the front. The position of the circuit board 64 at this time (i.e., the position of the circuit board 64 in FIG. 9) will be called a second position. When the circuit board 64 is in the second position, the top surface of the circuit board 64 faces diagonally upward and rearward. More specifically, the circuit board 64 in the second position faces upward and is sloped relative to the front-rear direction.

The circuit board 64 in the second position is positioned higher than the circuit board 64 in the first position (see FIG. 4).

The circuit board 64 is moved between the first position and second position by the pivot of the lever 68. In other words, the lever 68 moves the circuit board 64 between the first position and second position.

The substrate 63 of the circuit board 64 is formed of silicon, glass epoxy, or the like. The circuit board 64 is configured by mounting the memory 66 on the substrate 63 and forming four electrodes 65 on the substrate 63 (see FIG. 3B). Note that the substrate 63 may also be configured of a flexible substrate. Further, the number of electrodes 65 is determined in accordance with the number of contacts 132 in the cartridge-attachment portion 110 (see FIG. 2) and is not limited to four.

While the memory 66 is mounted on the top surface of the substrate 63 in the present embodiment, the memory 66 may be mounted on the bottom surface of the substrate 63 instead. The memory 66 stores information related to the ink cartridge 30 that can be read by the controller 1 of the printer 10. The information related to the ink cartridge 30 is data specifying a lot number, a manufactured date, an ink color, and the like. The memory 66 may be a semiconductor memory, such as a Static RAM (SRAM). Note that an integrated circuit (IC) providing function(s) other than a memory may also be mounted on the substrate 63, if necessary.

As illustrated in FIG. 3B, each of the four electrodes 65 corresponds to one of the four contacts 132 in the cartridge-attachment portion 110. Hence, the number of electrodes 65, as with the number of contacts 132, is not limited to four. The four electrodes 65 are exposed on the top surface of the substrate 63, allowing for electrical connections. Each electrode 65 is elongated in the front-rear direction. The electrodes 65 are arranged parallel to each other and are spaced apart from each other in the left-right direction on the top surface of the substrate 63. Each electrode 65 is electrically connected to the memory 66. As illustrated in FIG. 4, the electrodes 65 face upward when the circuit board 64 is in the first position. As illustrated in FIG. 9, the electrodes 65 face diagonally upward and rearward when the circuit board 64 is in the second position.

<Operations for Attaching the Ink Cartridge 30 to the Cartridge-Attachment Portion 110>

Next, operations for mounting the ink cartridge 30 in the cartridge holder 101 of the cartridge-attachment portion 110 will be described.

FIG. 4 illustrates the ink cartridge 30 prior to being mounted in the cartridge-attachment portion 110. At this time, the seal 141 seals the air communication port 140 so that the storage chamber 32 is not in communication with the atmosphere. Prior to mounting the ink cartridge 30 in the cartridge-attachment portion 110, the user peels off the seal 141, opening the storage chamber 32 to the atmosphere. Also, prior to the ink cartridge 30 being mounted in the cartridge-attachment portion 110, the valve 79 is in contact with the sealing member 76. Consequently, ink stored in the storage chamber 32 is prevented from flowing out of the ink cartridge 30 through the through-hole 76A.

In a state where the ink cartridge 30 is not attached to the cartridge-attachment portion 110, no member is positioned between the light-emitting part and light-receiving part of the optical sensor 113, enabling light to travel from the light-emitting part to the light-receiving part. At this time, the optical sensor 113 outputs a high level detection signal to the controller 1 (see FIG. 1). Further, prior to attachment of the ink cartridge 30 to the cartridge-attachment portion 110, the valve 115 closes the opening 102B, and the rear end of the valve 115 protrudes rearward from the opening 102B.

Also when the ink cartridge 30 is not mounted in the cartridge-attachment portion 110, the lever 68 is in the initial orientation and the circuit board 64 is in the first position.

Figure 7:
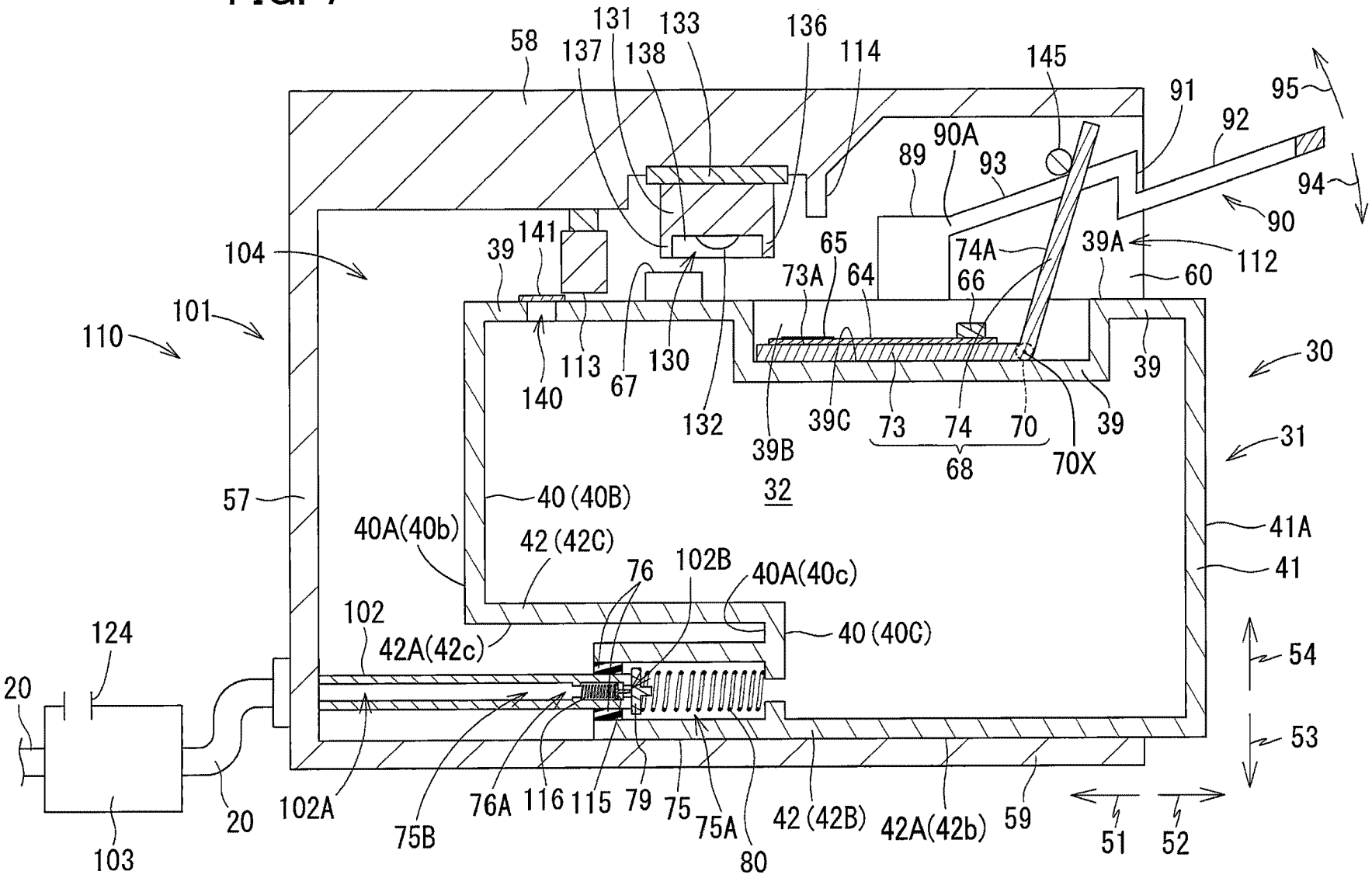
FIG. 7 is a vertical cross-sectional view of the ink cartridge according to the embodiment in the upright posture being inserted into the cartridge-attachment portion.

In order to attach the ink cartridge 30 to the cartridge-attachment portion 110, the ink cartridge 30 is inserted forward into the cartridge holder 101 through the opening 112 of the cartridge-attachment portion 110 (see FIG. 7).

As the ink cartridge 30 is inserted forward into the cartridge holder 101, as illustrated in FIG. 7, the tube 102 of the cartridge-attachment portion 110 is inserted into the passage 75A of the cylinder 75 through the through-hole 76A formed in the sealing member 76 (the opening 75B). At this time, the outer circumferential surface of the tube 102 closely contacts an inner circumferential surface of the sealing member 76 (the surface defining the through-hole 76A). This configuration not only fixes the position of the cylinder 75 when the ink cartridge 30 is in its attached state, but also forms a liquid-tight seal between the cylinder 75 and tube 102 that prevents ink from leaking into the cartridge holder 101.

The tube 102 inserted into the passage 75A also contacts and pushes the valve 79 rearward. Through this action, the valve 79 is separated from the sealing member 76 against a forward urging force of the coil spring 80.

Further, when the distal end of the tube 102 contacts the valve 79, the valve 79 contacts the valve 115 from the rear side thereof and pushes the valve 115 forward. Consequently, the valve 115 moves forward against the urging force of the coil spring 116. This action allows the interior space 102A of the tube 102 to communicate with the exterior of the tube 102 through the opening 102B.

As a result, ink stored in the storage chamber 32 can flow into the tank 103 and recording head 21 via the interior space 102A of the tube 102. At this time (in the state illustrated in FIG. 7), the circuit board 64 is not yet in contact with the cartridge-attachment portion 110.

Also, when the ink cartridge 30 is being inserted forward into the cartridge holder 101, as illustrated in FIG. 7, the contact surface 93 formed on the locking lever 90 of the ink cartridge 30 contacts the shaft 145 from the rear side. The shaft 145 is guided along the contact surface 93. Through the process of guiding the shaft 145, the locking lever 90 elastically deforms in the direction indicated by the arrow 94 in FIG. 7, in response to a reaction force from the shaft 145.

Also as the ink cartridge 30 is being inserted forward into the cartridge holder 101, as illustrated in FIG. 7, the front surface 74A of the second arm 74 constituting the lever 68 of the ink cartridge 30 contacts the shaft 145 from the rear side. As the ink cartridge 30 is inserted farther forward while the front surface 74A of the second arm 74 is in contact with the shaft 145, the lever 68 receives a rearward reaction force from the shaft 145. This rearward reaction force is converted to a pivoting force in the lever 68, causing the lever 68 to pivot in the direction indicated by the arrow 71 (see FIG. 4). Consequently, the lever 68 pivots from its initial orientation toward its sloped orientation against the weight of the first arm 73 and circuit board 64 (see FIG. 8). Through this pivot, the circuit board 64 moves from its first position toward its second position.

Figure 8:
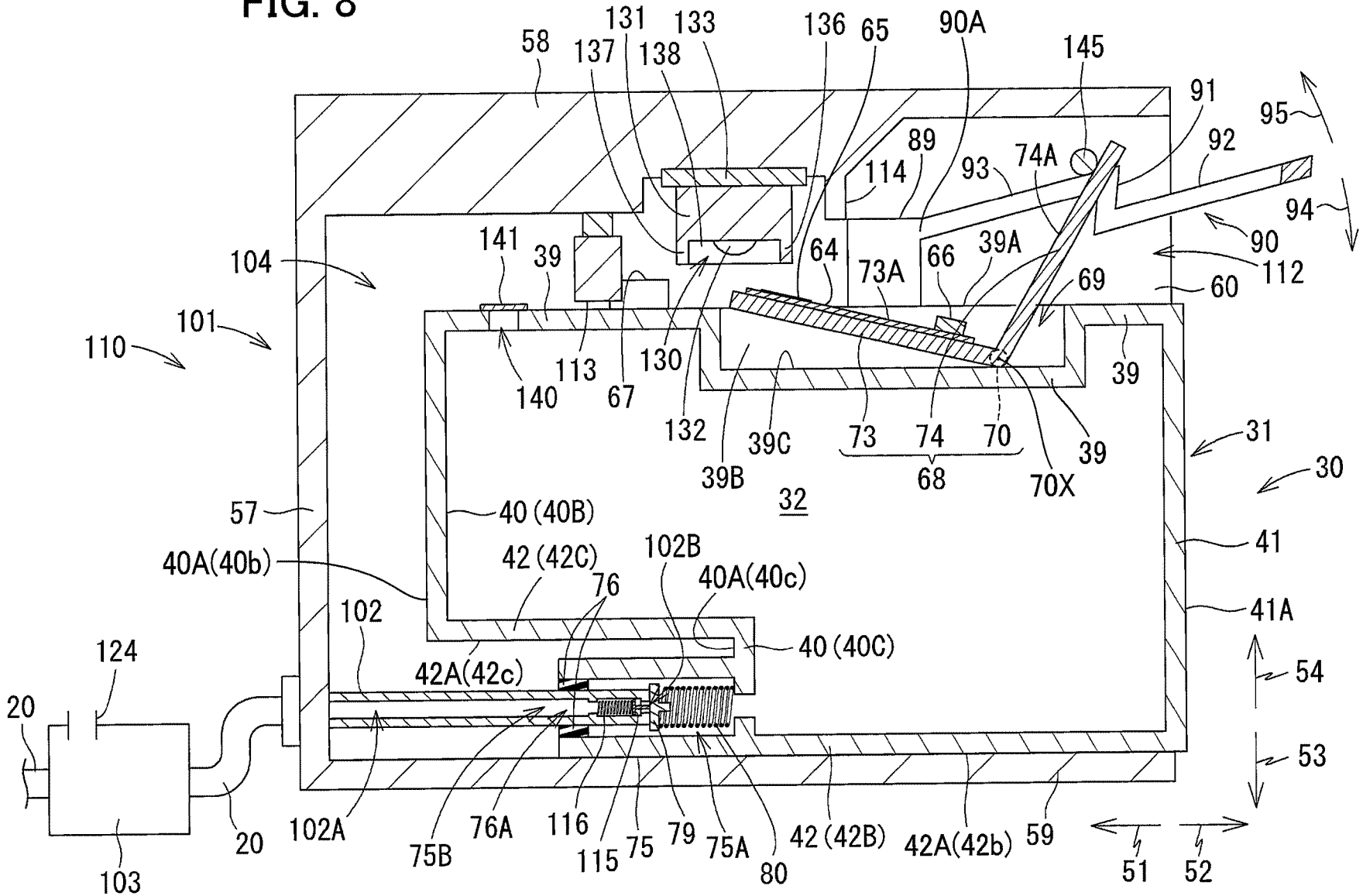
FIG. 8 is a vertical cross-sectional view of the ink cartridge according to the embodiment in the upright posture being further inserted into the cartridge-attachment portion than in FIG. 7.

When the ink cartridge 30 is inserted into the cartridge holder 101 further forward than in a state illustrated in FIG. 8, the ink cartridge 30 assumes a state illustrated in FIG. 9, the state of the ink cartridge 30 at this time is the attached state. In the attached state, the mounting of the ink cartridge 30 to the cartridge holder 101 is completed. Next, the states of components in the ink cartridge 30 and cartridge-attachment portion 110 while the ink cartridge 30 is in the attached state will be described.

As illustrated in FIG. 9, the tube 102 of the cartridge-attachment portion 110 has advanced into the passage 75A of the cylinder 75.

Also, as illustrated in FIG. 9, the contact surface 93 and engaging surface 91 formed on the locking lever 90 are positioned forward than the shaft 145. Consequently, the locking lever 90 is elastically returned in a direction indicated by an arrow 95 in FIG. 9. When the locking lever 90 is elastically returned to its natural state, the engaging surface 91 confronts the shaft 145 in the front-rear direction. When the user releases the ink cartridge 30, the ink cartridge 30 is moved rearward by the urging force of the coil spring 80. Through this movement, the engaging surface 91 contacts the shaft 145 from the front side thereof, thereby fixing the position of the ink cartridge 30 in the front-rear direction.

When the locking lever 90 has returned elastically to its natural state, the lever 68 has been rotated to its sloped orientation owing to the reaction force from the shaft 145. At this time, the front surface 74A formed on the second arm 74 of the lever 68 in the sloped orientation extends to a position farther rearward than the engaging surface 91 of the locking lever 90. When the user releases the ink cartridge 30, the second arm 74 of the lever 68 is urged to pivot in a forward direction, but the lever 68 cannot pivot due to the engagement of the shaft 145 and engaging surface 91. Accordingly, the lever 68 is maintained in its sloped orientation when the ink cartridge 30 is in the attached state.

As illustrated in FIG. 9, the top surface on the protruding parts 89 of the ink cartridge 30 also contacts the bottom surface on the protruding part 114 of the cartridge-attachment portion 110. At the same time, the bottom surface 42A of the ink cartridge 30 is in contact with the top surface of the bottom wall 59 constituting the cartridge-attachment portion 110. This contact fixes the vertical position of the ink cartridge 30.

As illustrated in FIG. 9, the projection 67 is positioned between the light-emitting part and light-receiving part of the optical sensor 113. Consequently, the projection 67 blocks the progression of light from the light-emitting part to the light-receiving part. That is, the projection 67 is positioned in the optical path of light irradiated from the light-emitting part when the ink cartridge 30 is in the attached state. In other words, the optical sensor 113 is positioned such that the light-blocking surface of the projection 67 is in the optical path of light irradiated from the light-emitting part when the ink cartridge 30 is in the attached state. At this time, the optical sensor 113 outputs a low level detection signal to the controller 1 (see FIG. 1).

During the process of transitioning from the state illustrated in FIG. 8 to the state illustrated in FIG. 9 as the ink cartridge 30 is being inserted into the cartridge-attachment portion 110, the distal end of the first arm 73 and the front portion of the circuit board 64 supported on the first arm 73 pass through a position directly beneath the rear wall 136 of the connector 130 in the cartridge-attachment portion 110 and move to a position farther forward than the rear wall 136.

As the ink cartridge 30 is inserted farther forward into the cartridge-attachment portion 110 from this state, the lever 68 begins to pivot. Accordingly, the distal end of the first arm 73 and the front portion of the circuit board 64 positioned forward of the rear wall 136 advance into the space in the connector 130 surrounded by the rear wall 136, front wall 137, right wall 138, and left wall 139. Specifically, this space is defined in the case 131 of the connector 130 not only by the rear wall 136, front wall 137, right wall 138, and left wall 139, but also by the bottom surface 131A of the case 131. Thus, the distal end of the first arm 73 and the front portion of the circuit board 64 move to a position higher than the bottom edges of the rear wall 136, front wall 137, right wall 138, and left wall 139.

As the ink cartridge 30 is inserted farther forward into the cartridge holder 101 from this state, the lever 68 positioned inside the space formed in the connector 130 arrives in its sloped orientation, while the circuit board 64 positioned inside the space of the connector 130 arrives at its second position. After the first arm 73 and circuit board 64 have entered the space formed in the connector 130, the distal end of the first arm 73 and the front portion of the circuit board 64 continue to move upward in this space until the lever 68 has arrived in the sloped orientation and the circuit board 64 has arrived in the second position. When the circuit board 64 arrives in the second position, the electrodes 65 contact the bottoms of corresponding contacts 132. Hence, by pivoting the lever 68 to its sloped orientation (by moving the circuit board 64 to its second position), the electrodes 65 can be placed in contact with the bottoms of the contacts 132 to form an electrical connection with the same.

With the four electrodes 65 contacting the corresponding contacts 132 so that electricity can be conducted therebetween, a voltage Vc is applied to the electrodes 65, the electrodes 65 are grounded, and power is supplied to the electrodes 65. Through these electrical connections between the contacts 132 and electrodes 65, the memory 66 mounted on the circuit board 64 is also electrically connected to the controller 1 (see FIG. 1). Consequently, the controller 1 can access the memory 66, enabling data stored in the memory 66 to be inputted into the controller 1 (see FIG. 1).

When the ink cartridge 30 is in the attached state illustrated in FIG. 9, the front wall 137 of the connector 130 is positioned frontward of the circuit board 64, and the rear wall 136 of the connector 130 is positioned rearward of the circuit board 64. Further, the bottom edges of the rear wall 136 and front wall 137 are positioned lower than the electrodes 65. With this arrangement, the electrodes 65 are interposed between the front wall 137 and rear wall 136 in the front-rear direction when the ink cartridge 30 is in the attached state. That is, the rear wall 136 and front wall 137 are juxtaposed in the front-rear direction with the electrodes 65 interposed therebetween.

As illustrated in FIG. 3B, the right wall 138 of the connector 130 is on the right side of the circuit board 64, and the left wall 139 of the connector is on the left side of the circuit board 64 when the ink cartridge 30 is in the attached state. Further, bottom edges of the right wall 138 and left wall 139 are positioned lower than the electrodes 65. With this configuration, the right wall 138 and left wall 139 enclose the electrodes 65 from the left and right sides when the ink cartridge 30 is in the attached state. That is, the right wall 138 and left wall 139 are juxtaposed in the left-right direction with the electrodes 65 interposed therebetween.

To extract the ink cartridge 30 from the cartridge holder 101 of the cartridge-attachment portion 110 in the state illustrated in FIG. 9, the user pushes the operating part 92 of the locking lever 90 downward. As a result, the locking lever 90 elastically deforms in the direction indicated by the arrow 94, thereby moving the engaging surface 91 to a position lower than the shaft 145. Consequently, the urging force of the coil spring 80 moves the ink cartridge 30 rearward relative to the cartridge holder 101.

When the ink cartridge 30 moves rearward relative to the cartridge holder 101, the second arm 74 separates from the shaft 145. Since the second arm 74 no longer receives a rearward reaction force from the shaft 145, the lever 68 pivots from its sloped orientation to its initial orientation owing to the weight of the first arm 73 and the circuit board 64. As the lever 68 pivots, the circuit board 64 moves from the second position to the first position. That is, the circuit board 64 separates from the contacts 132. Since the circuit board 64 moves in the direction of gravity owing to its weight and separates from the contacts 132, friction in the front-rear direction can be reduced between the contacts 132 and the circuit board 64 as the ink cartridge 30 is being pulled outward.

Through the above operation, the user can then remove the ink cartridge 30 from the cartridge-attachment portion 110.

<Detecting Attachment of the Ink Cartridge 30 to the Cartridge-Attachment Portion 110>

Next, operations for detecting when an ink cartridge 30 is inserted into the cartridge-attachment portion 110 will be described with reference to flowcharts illustrated in FIGS. 10 and 11.

Figure 10:
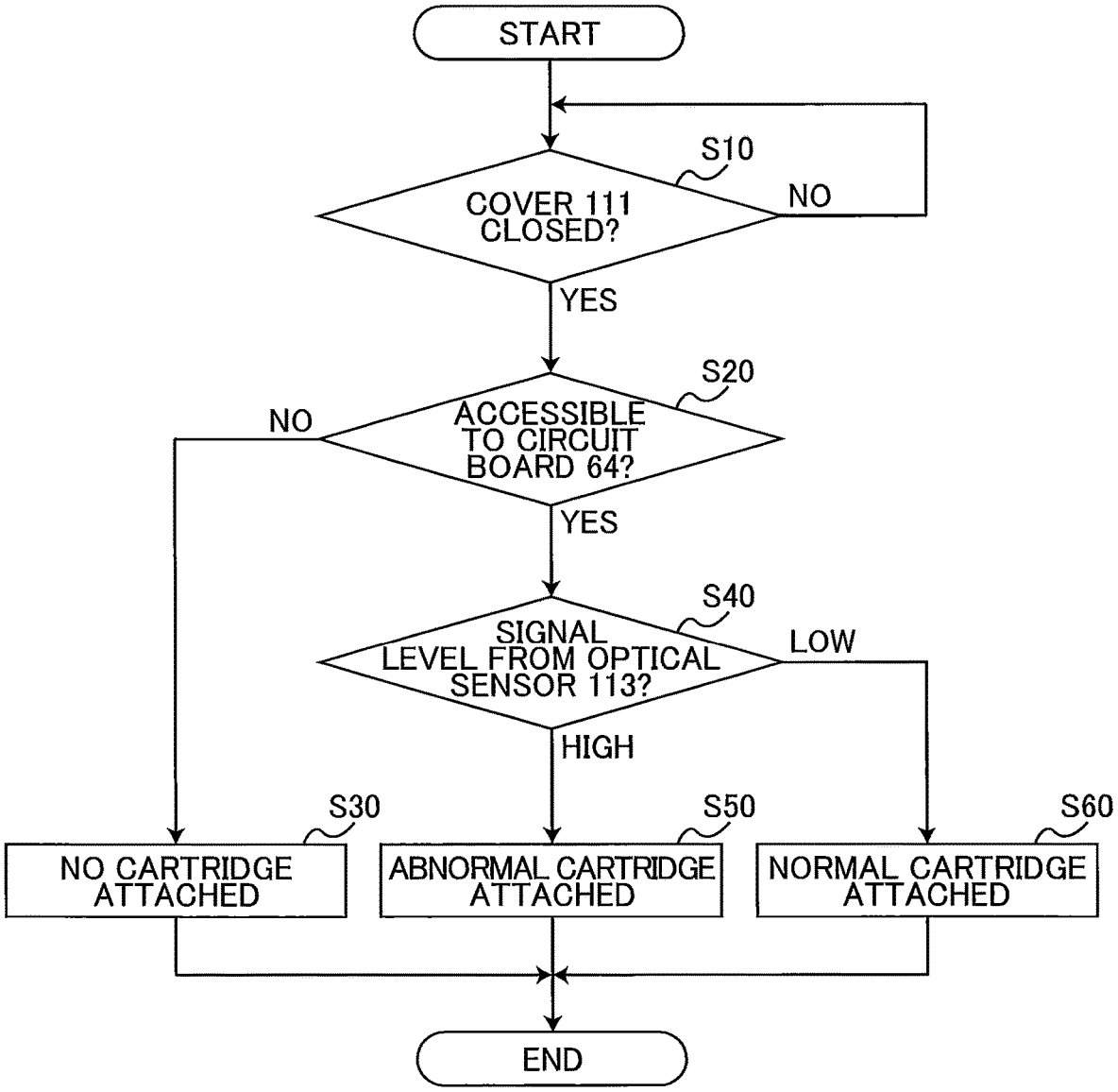
FIG. 10 is a flowchart illustrating steps to determine whether the ink cartridge according to the embodiment is attached to the cartridge-attachment portion.
Figure 11:
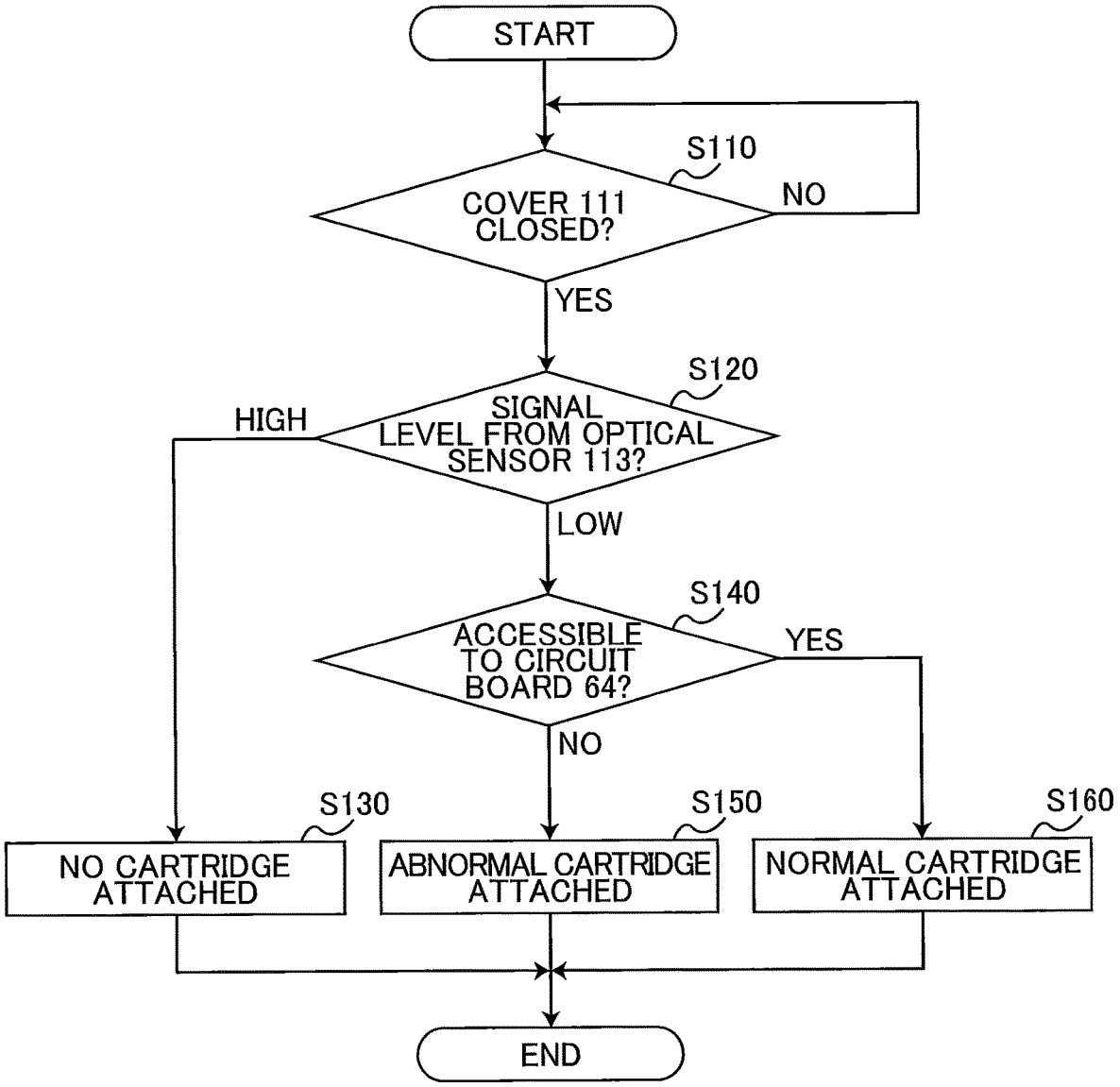
FIG. 11 is a flowchart illustrating another way of steps to determine whether the ink cartridge according to the embodiment is attached to the cartridge-attachment portion.

The flowcharts of FIGS. 10 and 11 are configured to be initiated when the cover 111 is opened by the user. That is, the controller 1 is configured to launch the flowchart of FIG. 10 or the flowchart of FIG. 11 in response to receiving a high level signal outputted from the cover sensor 118.

As illustrated in FIG. 10, in S10 the controller 1 (see FIG. 1) determines whether the cover 111 is in the closed position. The controller 1 determines that the cover 111 is in the closed position when the signal outputted from the cover sensor 118 changes to a low level signal.

In a case where the cover 111 is not in the closed position (S10: NO), the controller 1 repeats the determination in S10 until the cover 111 is determined to be closed, i.e., until the signal outputted from the cover sensor 118 changes from high level to low level.

When the cover 111 is determined to be in the closed position (S10: YES), in S20 the controller 1 determines whether the memory 66 on the circuit board 64 of the ink cartridge 30 is accessible, i.e., whether the controller 1 can read from or write to the memory 66. When the contacts 132 are in contact with and electrically connected to the electrodes 65 on the circuit board 64, the controller 1 is able to access the memory 66 on the circuit board 64. When the contacts 132 are not in contact with the electrodes 65 on the circuit board 64, the controller 1 cannot access the memory 66.

If the controller 1 cannot access the memory 66 (S20: NO), in S30 the controller 1 determines that an ink cartridge 30 is not mounted in the cartridge-attachment portion 110. In this case, the controller 1 notifies the user that an ink cartridge 30 is not mounted by displaying a message on a display panel (not illustrated) provided on a housing of the printer 10 and/or emitting a beep or other sound from a speaker (not illustrated).

However, when the controller 1 can access the circuit board 64 (S20: YES), in S40 the controller 1 determines whether the signal outputted from the optical sensor 113 to the controller 1 is high level or low level. When the projection 67 is positioned between the light-emitting part and light-receiving part of the optical sensor 113, the optical sensor 113 outputs a low level signal to the controller 1. When the projection 67 is not positioned between the light-emitting part and light-receiving part of the optical sensor 113, the optical sensor 113 outputs a high level signal to the controller 1.

When the signal outputted from the optical sensor 113 to the controller 1 is high level (S40: HIGH), in S50 the controller 1 determines that an abnormal ink cartridge 30 is attached to the cartridge-attachment portion 110. In this case, the controller 1 notifies the user that an abnormal ink cartridge 30 is mounted by displaying a message on the display panel (not illustrated) provided on the housing of the printer 10 and/or playing a beep or other sound from the speaker (not illustrated).

On the other hand, if the signal outputted by the optical sensor 113 is low level (S40: LOW), in S60 the controller 1 determines that a normal ink cartridge 30 is attached to the cartridge-attachment portion 110.

In the flowchart of FIG. 10, the controller 1 determines whether an ink cartridge 30 is mounted in the cartridge-attachment portion 110 on the basis of whether the circuit board 64 is accessible, and determines whether the ink cartridge 30 mounted in the cartridge-attachment portion 110 is normal on the basis of the level of the signal outputted from the optical sensor 113.

However, the controller 1 may be configured to determine whether an ink cartridge 30 is mounted in the cartridge-attachment portion 110 on the basis of the level of the signal outputted from the optical sensor 113 and to determine whether the ink cartridge 30 mounted in the cartridge-attachment portion 110 is normal on the basis of whether the circuit board 64 is accessible. Steps in this variation will be described next with reference to the flowchart in FIG. 11.

Referring to FIG. 11, the controller 1 first determines in S110 whether the cover 111 is in the closed position, as in the flowchart of FIG. 10. The controller 1 repeats the determination in S110 (S110: NO) until the cover 111 is determined to be in the closed position, i.e., until the signal outputted from the cover sensor 118 changes from high level to low level.

When the controller 1 determines in S110 that the cover 111 is in the closed position (S110: YES), in S120 the controller 1 determines whether the signal outputted from the optical sensor 113 to the controller 1 is high level or low level.

If the signal outputted by the optical sensor 113 is high level (S120: HIGH), in S130 the controller 1 determines that an ink cartridge 30 is not mounted in the cartridge-attachment portion 110. In this case, as in S30 of FIG. 10, the controller 1 notifies the user that an ink cartridge 30 is not mounted.

However, if the signal outputted by the optical sensor 113 is low level (S120: LOW), in S140 the controller 1 determines whether the circuit board 64 of the ink cartridge 30 is accessible.

If the controller 1 cannot access the circuit board 64 (S140: NO), in S150 the controller 1 determines that an abnormal ink cartridge 30 is mounted in the cartridge-attachment portion 110. In this case, as in S50 of FIG. 10, the controller 1 notifies the user that an abnormal ink cartridge 30 is mounted.

On the other hand, if the controller 1 can access the circuit board 64 (S140: YES), in S160 the controller 1 determines that a normal ink cartridge 30 is mounted in the cartridge-attachment portion 110.

<Operational and Technical Advantages of the Embodiment>

According to the present embodiment, the circuit board 64 moves along with the pivot of the lever 68. The momentum of this movement can dislodge any dust or foreign matter adhering to the electrodes 65 of the circuit board 64.

When in the second position, the circuit board 64 in the present embodiment slopes relative to the front-rear direction. Accordingly, any foreign matter deposited on the top surface of the circuit board 64 is likely to slide off the circuit board 64 when the circuit board 64 is in the second position.

Since the lever 68 is positioned near the top surface 39A of the top wall 39 in the present embodiment, any ink that flows out from the passage 75A is unlikely to become deposited on the lever 68.

In the first position, the circuit board 64 according to the present embodiment is positioned lower than the top surface 39A of the top wall 39. This arrangement can reduce the potential for damage to the circuit board 64.

Since the circuit board 64 is supported on the first arm 73 in the present embodiment, the orientation of the circuit board 64 can be stabilized by establishing the orientation of the lever 68.

In the present embodiment, the lever 68 is provided with the second arm 74. With this configuration, the circuit board 64 can be moved upward when the front surface 74A of the second arm 74 contacts the cartridge-attachment portion 110 from the rear side.

In the present embodiment, the contacts 132 are interposed between the rear wall 136 and front wall 137. However, the circuit board 64 in the present embodiment can be moved vertically by the pivot of the lever 68. Hence, despite the presence of the rear wall 136 and front wall 137, the circuit board 64 can be moved to a position at which the electrodes 65 contact the contacts 132 during the process of inserting the ink cartridge 30 into the cartridge-attachment portion 110.

In the present embodiment, the cartridge-attachment portion 110 contacts the rubber sealing member 76 prior to contacting the circuit board 64 during the process of mounting the ink cartridge 30 in the cartridge-attachment portion 110. This contact reduces the speed at which the ink cartridge 30 is inserted and can soften the force of impact to the circuit board 64.

First Modification

Figure 12:
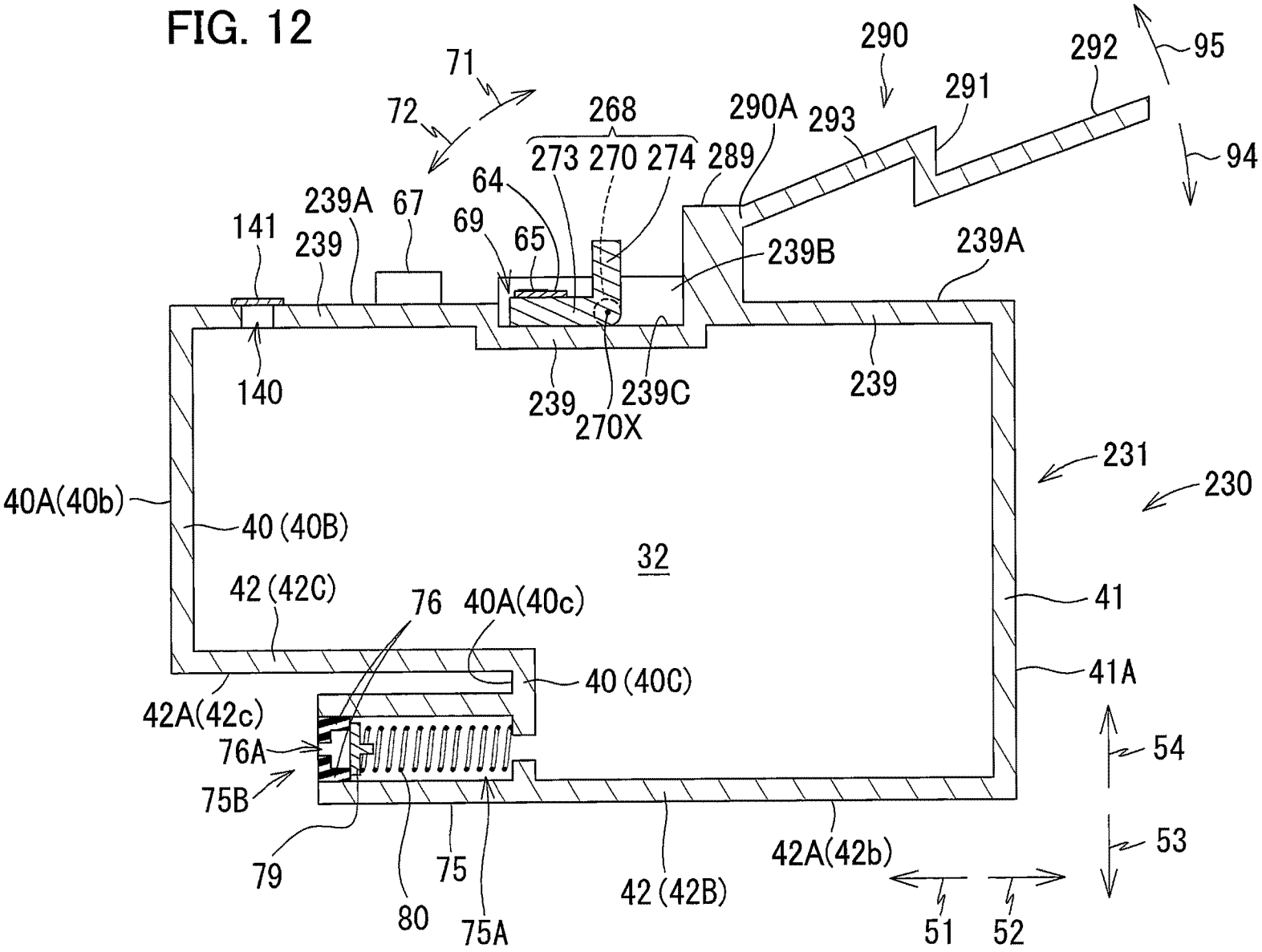
FIG. 12 is a vertical cross-sectional view of an ink cartridge according to a first modification to the embodiment.
Figure 13:
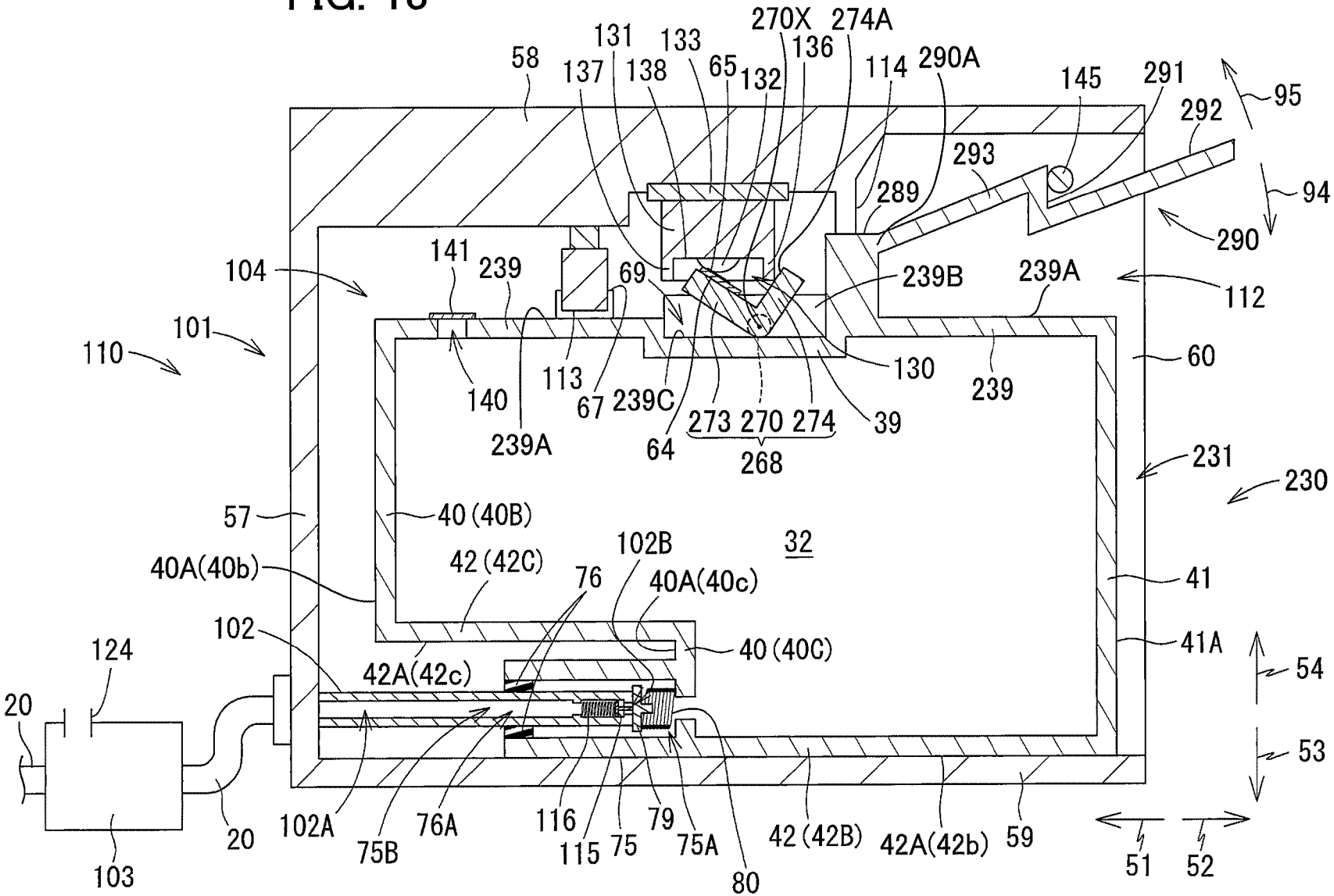
FIG. 13 is a vertical cross-sectional view of the ink cartridge according to the first modification to the embodiment attached to the cartridge-attachment portion.

In the embodiment described above, the lever 68 is pivoted due to contact with the shaft 145. However, the lever 68 may be pivoted through contact with a member other than the shaft 145. FIG. 12 illustrates the structure of an ink cartridge 230 according to a first modification of the embodiment in which the ink cartridge 230 is provided with a housing 231 and a lever 268. FIG. 13 illustrates the ink cartridge 230 according to the first modification of the embodiment attached to the cartridge-attachment portion 110. In the first modification illustrated in FIGS. 12 and 13, the lever 268 pivots when contacting the rear wall 136 of the connector 130.

In this modification, the rear wall 136 is positioned closer to the contacts 132 than the shaft 145 is to the contacts 132. Accordingly, as illustrated in FIG. 12, the lever 268 is formed smaller than the lever 68 in the embodiment described above (the structure illustrated in FIG. 4).

In conformance with the size of the lever 268, a recessed part 269 is also configured to be smaller than in the embodiment described above. Hence, unlike the structure illustrated in FIG. 4, in the structure illustrated in FIG. 12, a single protruding part 289 is provided on the top surface 239A of a top wall 239 of the housing 231, and the entire recessed part 269 is positioned forward of the single protruding part 289. A single locking lever 290 protrudes from the protruding part 289. The locking lever 290 is provided with a single contact surface 293, a single engaging surface 291, and an operating part 292, and is connected to the protruding part 289 at a proximal end 290A thereof.

The structure of the lever 268 is similar to that in the embodiment described above. That is, the lever 268 is provided with shafts 270, a first arm 273, and a second arm 274. The shafts 270 are pivotably supported in side surfaces 239B of the recessed part 269. The first arm 273 extends forward from the shafts 270 and supports the circuit board 64. The second arm 274 extends upward from the shafts 270. The lever 268 can pivot about a pivot axis 270X between the initial orientation illustrated in FIG. 12, and the sloped orientation illustrated in FIG. 13. The lever 268 is in its initial orientation when no external force is being applied thereto. By pivoting the lever 268 from its initial orientation to the sloped orientation, the circuit board 64 pivots from the first position illustrated in FIG. 12 to the second position illustrated in FIG. 13. Note that the memory 66 has been omitted from the drawings in FIGS. 11 and 12.

During the process of inserting the ink cartridge 230 into the cartridge-attachment portion 110, the front surface 274A on the second arm 274 of the lever 268 contacts the rear wall 136 of the connector 130 from the rear side. If the ink cartridge 230 is inserted farther forward into the cartridge holder 101 in this state, the lever 268 is pivoted from the initial orientation to the sloped orientation due to a reaction force from the rear wall 136 (see FIG. 13). Hence, the lever 268 pivots so that the circuit board 64 moves from the first position to the second position. Through this operation, the electrodes 65 on the circuit board 64 contact the bottoms of corresponding contacts 132 and form electrical connections with the contacts 132, as illustrated in FIG. 13. As illustrated in FIG. 13, pivot of the lever 268 in a direction that moves the front surface 274A forward (the direction indicated by the arrow 72 in FIG. 12) is restricted because the front surface 274A is in contact with the rear wall 136, and pivot of the lever 268 in a direction that moves the front surface 274A rearward (the direction indicated by the arrow 71 in FIG. 12) is restricted because the circuit board 64 is in contact with the contacts 132. With this configuration, the front surface 274A is maintained in a state of contact with the rear wall 136 when the ink cartridge 230 is in the attached state.

In the first modification described above, the contacts 132 that connect with electrodes 65 on the circuit board 64 are provided in the connector 130 that is contacted by the front surface 274A of the second arm 274. Accordingly, the lever 268 can be made more compact.

Second Modification

Figure 14:
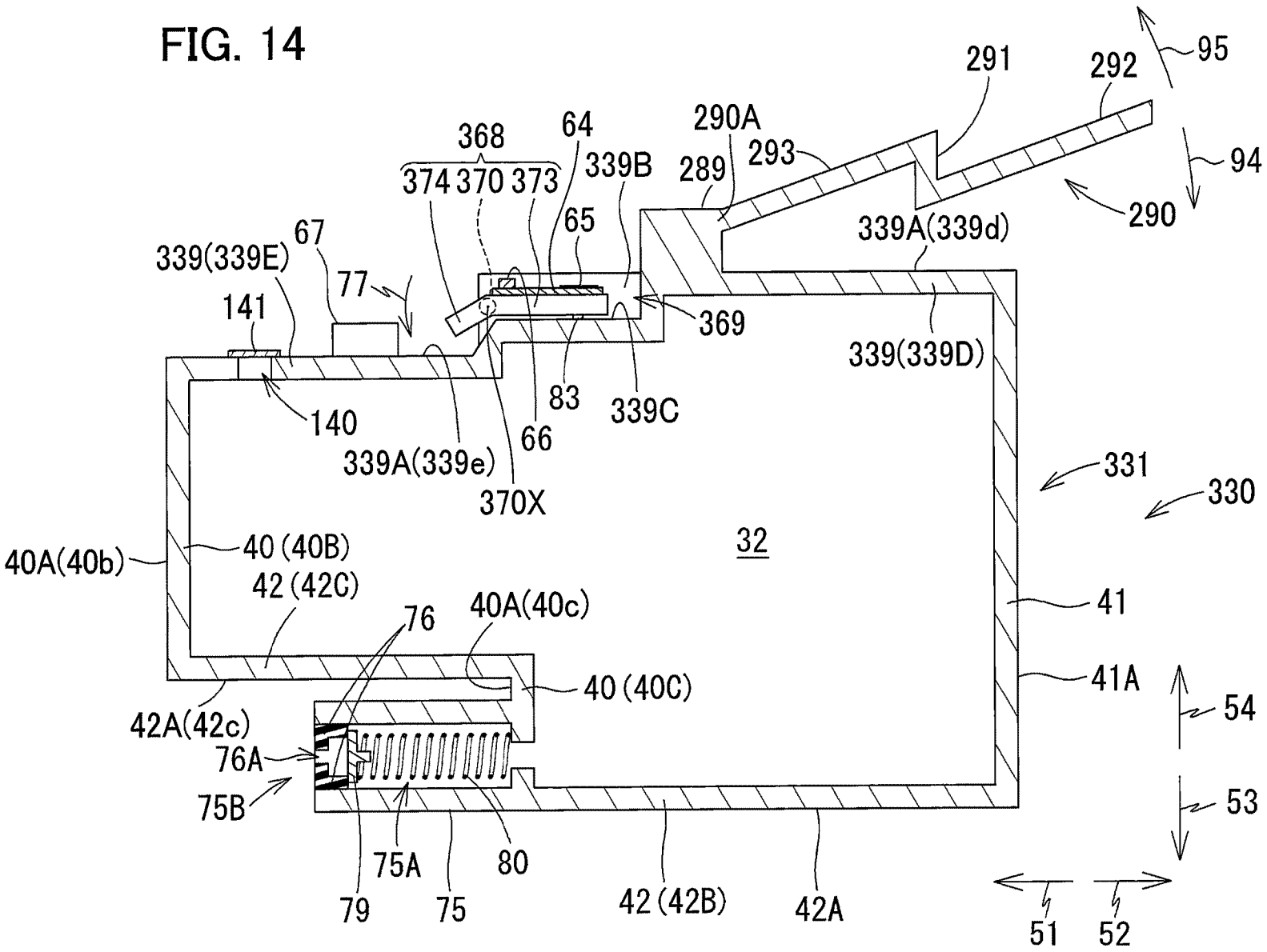
FIG. 14 is a vertical cross-sectional view of an ink cartridge according to a second modification to the embodiment.

While the first arm 73 of the lever 68 extends forward from the shafts 70 when the lever 68 is in the initial orientation, the first arm 73 may instead extend rearward from the shafts 70, as in the second modification illustrated in FIG. 14. In other words, the circuit board 64 may be positioned rearward of the shafts 70.

Figure 15:
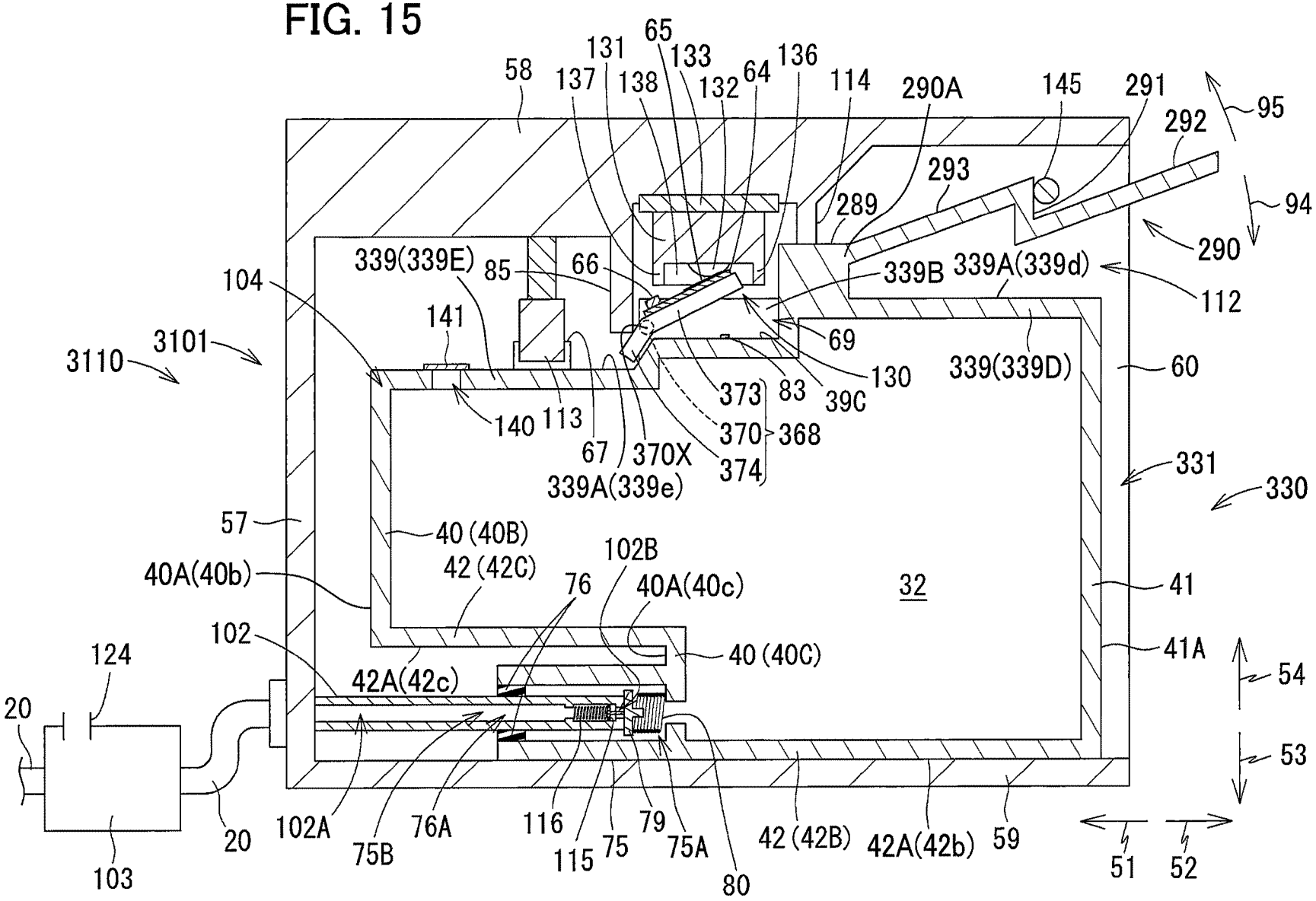
FIG. 15 is a vertical cross-sectional view of the ink cartridge according to the second modification to the embodiment attached to the cartridge-attachment portion.

FIG. 14 illustrates the structure of an ink cartridge 330 according to a second modification of the embodiment in which the ink cartridge 330 is provided with a housing 331 and a lever 368. FIG. 15 illustrates the ink cartridge 330 according to the second modification to the embodiment attached to the cartridge-attachment portion 110. In the second modification illustrated in FIGS. 14 and 15, the lever 368 is provided with shafts 370, a first arm 373, and a second arm 374. The first arm 373 extends rearward from the shafts 370 and supports the circuit board 64. The second arm 374 extends diagonally downward and forward from the shafts 370.

In conformance with the structure of the lever 368, in the second modification, a top wall 339 of the housing 331 is configured of a top wall 339D and a top wall 339E positioned frontward than the top wall 339D in the front-rear direction, as illustrated in FIG. 14. A recessed part 369 is formed at the front end portion of the top wall 339D, and is positioned to the front of a protruding part 389, as in the structure according to the first modification illustrated in FIG. 12. The top wall 339E is positioned lower than the top wall 339D and a bottom surface of the recessed part 369. A top surface 339*d* of the top wall 339D and a top surface 339*e* of the top wall 339E constitute a top surface 339A of the top wall 339.

The shafts 370 of the lever 368 are pivotably supported in a side surface 339B of the recessed part 369. The lever 368 can pivot about a pivot axis 370X between the initial orientation illustrated in FIG. 14 and the sloped orientation illustrated in FIG. 15. The lever 368 is in its initial orientation when no external force is being applied thereto. By pivoting the lever 368 from its initial orientation to the sloped orientation, the circuit board 64 rotates from the first position illustrated in FIG. 14 to the second position illustrated in FIG. 15.

In the structure illustrated in FIG. 14, the ink cartridge 330 is provided with stoppers 83 that protrude inward from the side surfaces 339B defining the recessed part 369. The stoppers 83 are positioned lower than the circuit board 64 when the circuit board 64 is in the first position and support the lever 368 in the initial orientation. Thus, the stoppers 83 restrict the circuit board 64 from moving farther downward from the first position. In the embodiment described above (in the structure illustrated in FIG. 4), the bottom surface 39C defining the recessed part 69 functions as a stopper for restricting the circuit board 64 from moving farther downward from the first position. However, the ink cartridge 30 in the embodiment may instead be provided with stoppers 83. Similarly, the ink cartridge 230 in the first modification or other embodiments may also be provided with stoppers 83.

As illustrated in FIG. 15, a cartridge-attachment portion 3110 is provided with a protruding part 85 positioned between the optical sensor 113 and connector 130 in the front-rear direction. During the process of inserting the ink cartridge 330 into the cartridge-attachment portion 3110, the second arm 374 of the lever 368 contacts the protruding part 85 from the rear. When the ink cartridge 330 is inserted farther forward into a cartridge holder 3101 while the second arm 374 is in a state of contact with the protruding part 85, the lever 368 is pivoted in a direction of an arrow 77 (see FIG. 14) due to a reaction force from the protruding part 85. Hence, the lever 368 pivots from the initial orientation to the sloped orientation, and the circuit board 64 pivots from the first position to the second position. Through this action, the electrodes 65 on the circuit board 64 contact the bottoms of the corresponding contacts 132 and form electrical connections with the contacts 132, as illustrated in FIG. 15. While the ink cartridge 330 is in the attached state, the lever 368 is urged by its own weight to rotate clockwise in FIG. 15 so as to separate from the contacts 132 inside the cartridge holder 101. However, the contact between the protruding part 85 and the second arm 374 inhibits this rotation. Thus, electrical connections are maintained between the electrodes 65 on the circuit board 64 and the contacts 132 in the cartridge holder 101 while the ink cartridge 330 is in its attached state.

Third Modification

Figure 16:
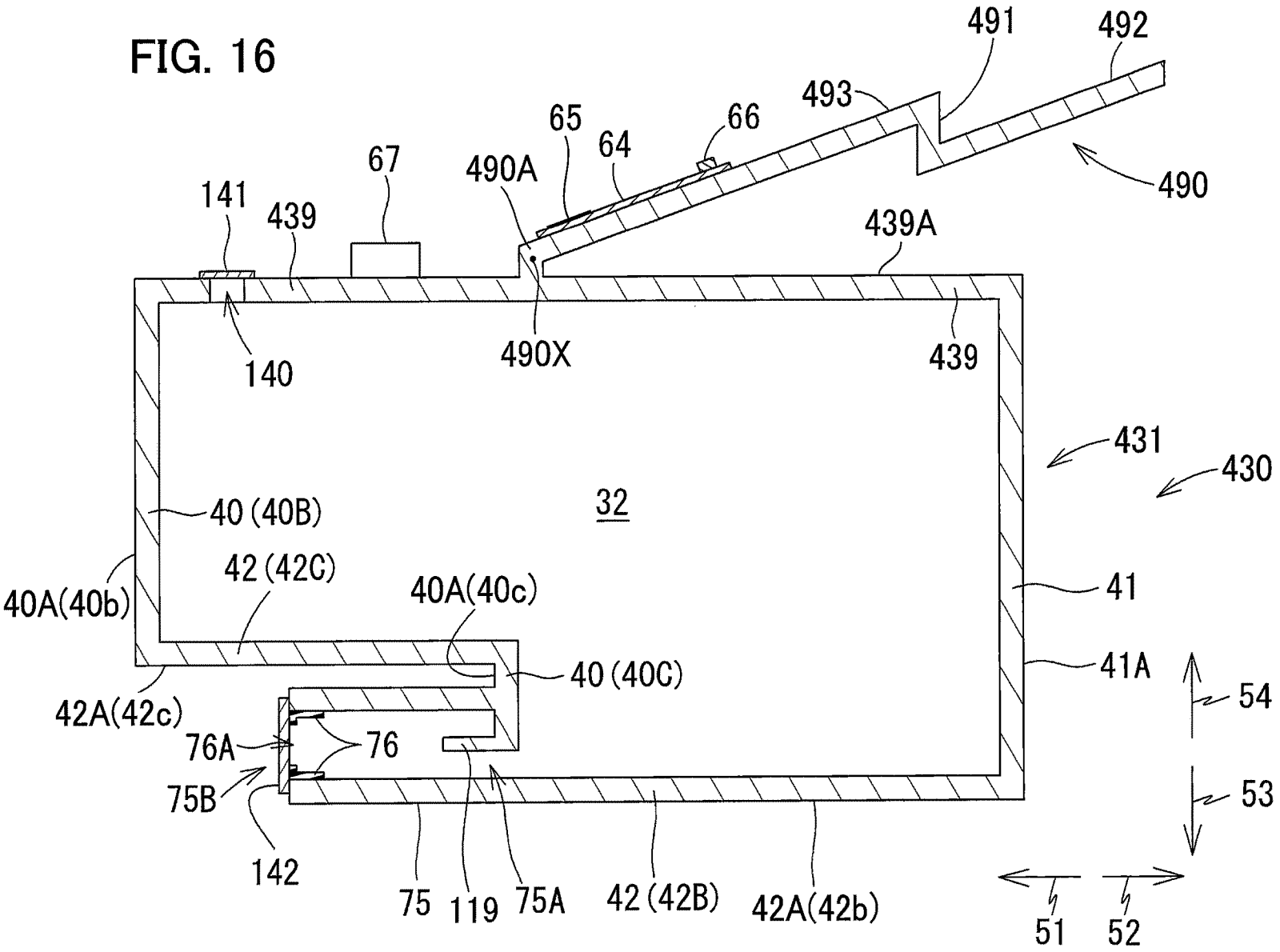
FIG. 16 is a vertical cross-sectional view of an ink cartridge according to a third modification to the embodiment.
Figure 17:
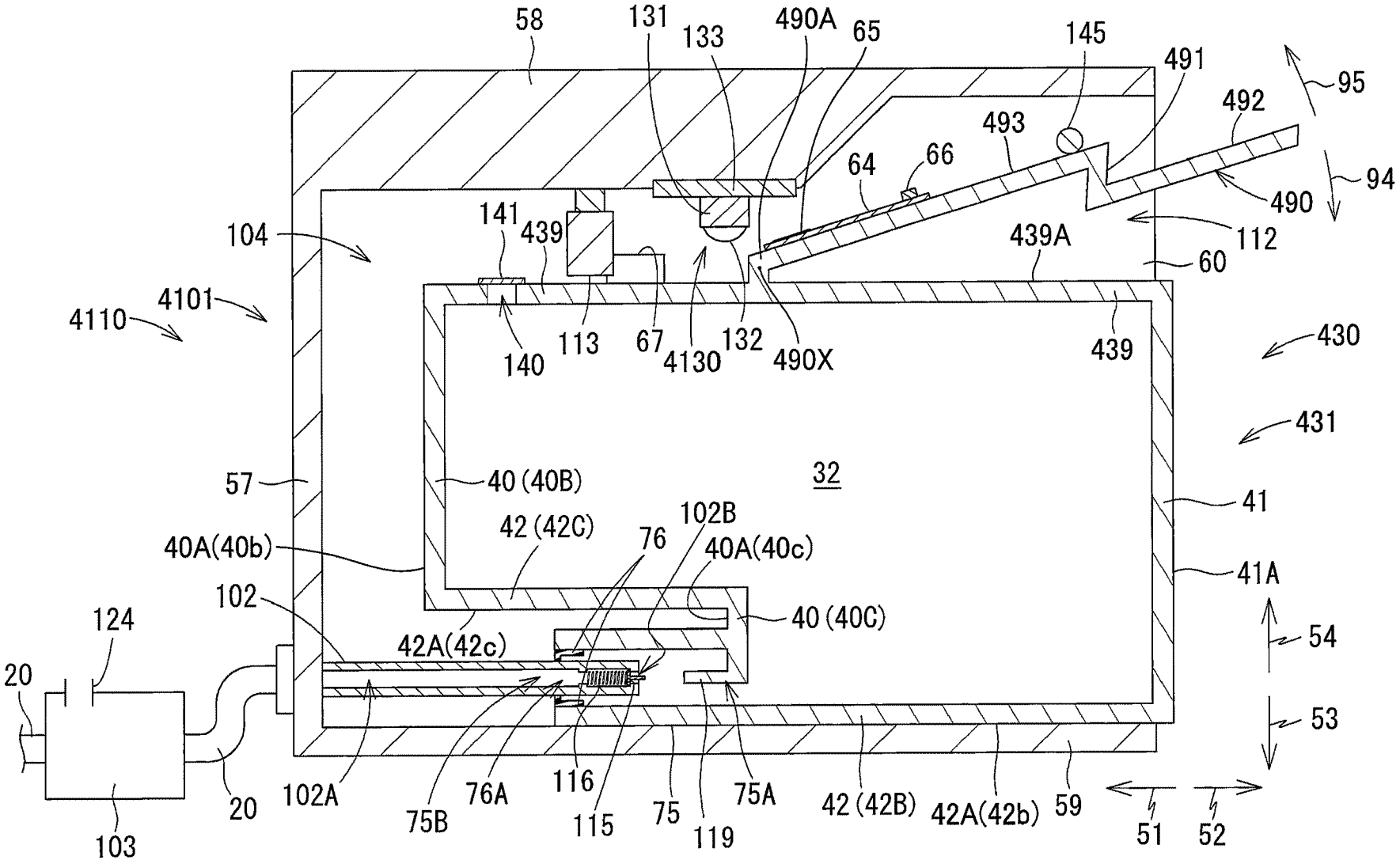
FIG. 17 is a vertical cross-sectional view of the ink cartridge according to the third modification to the embodiment in the upright posture being inserted into the cartridge-attachment portion.
Figure 18:
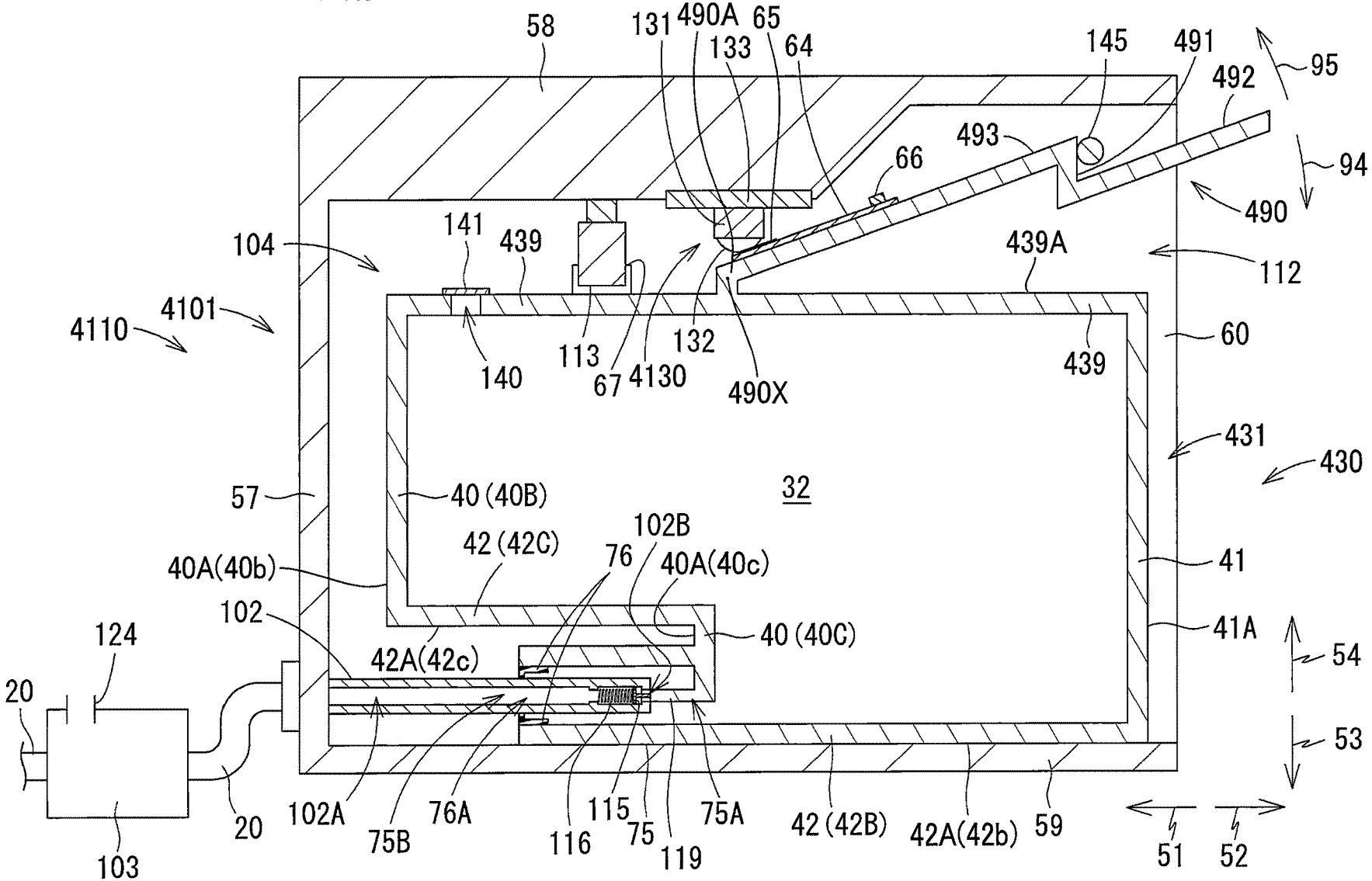
FIG. 18 is a vertical cross-sectional view of the ink cartridge according to the third modification to the embodiment attached to the cartridge-attachment portion.

FIG. 16 illustrates the structure of an ink cartridge 430 according to a third modification of the embodiment in which the ink cartridge 430 is provided with a housing 431 and a locking lever 490. FIGS. 17 and 18 illustrate the ink cartridge 430 according to the third modification to the embodiment attached to a cartridge-attachment portion 4110.

In the third modification illustrated in FIGS. 16 through 18, the circuit board 64 is mounted on the locking lever 490. As in the embodiment described above, the locking lever 490 is provided with a contact surface 493, an engaging surface 491, and an operating part 492. In the structure illustrated in FIG. 16, the circuit board 64 is bonded to the contact surface 493 of the locking lever 490. Both the contact surface 493 and the circuit board 464 face diagonally upward and forward. The engaging surface 491 faces rearward.

A proximal end 490A of the locking lever 490 is positioned on a top surface 439A of a top wall 439 of the housing 411 and positioned farther forward than the proximal end 90A of the locking lever 90 in the embodiment described above (see FIG. 4). The contact surface 493 of the locking lever 490 in the third modification is longer in the front-rear direction than the contact surface 93 of the locking lever 90 according to the embodiment by the distance in which the proximal end 490A of the third modification is farther forward than the proximal end 90A of the embodiment. By operating the operating part 492, the user can elastically deform the locking lever 490 in directions indicated by arrows 94 and 95 (see FIG. 17). Hence, the locking lever 490 can pivot about a pivot axis 490X in direction indicated by the arrows 94 and 95. The pivot axis 490X is an axis extending in the left-right direction at the proximal end 490A of the locking lever 490.

The circuit board 64 is positioned rearward of the proximal end 490A and forward of the engaging surface 491 and operating part 492. That is, the circuit board 64 is disposed between the proximal end 490A and engaging surface 491.

While the ink cartridge 430 has not yet been inserted into a cartridge holder 4101 of the cartridge-attachment portion 4110 (the state illustrated in FIG. 16), the circuit board 64 remains in the second position. At this time, the circuit board 64 and the electrodes 65 formed on the circuit board 64 face diagonally upward and forward.

During the process of inserting the ink cartridge 430 into the cartridge holder 4101, the contact surface 493 of the locking lever 490 in the ink cartridge 430 contacts the shaft 145 in the cartridge-attachment portion 4110 from the rear side, as illustrated in FIG. 17. The shaft 145 is guided along the contact surface 493. During this guiding process, the locking lever 490 is elastically deformed in the direction indicated by the arrow 94 by a reaction force from the shaft 145 (see FIG. 17). Accordingly, the circuit board 64 moves from the second position toward the first position.

When the ink cartridge 430 is inserted farther into the cartridge holder 4101, the contact surface 493 and engaging surface 491 of the locking lever 490 move farther forward than the shaft 145. At this time, the locking lever 490 elastically returns in the direction indicated by the arrow 95 (see FIG. 18). After the locking lever 490 has elastically returned to its natural state, the engaging surface 491 confronts the shaft 145 in the front-rear direction. When the user releases the ink cartridge 430, the ink cartridge 430 is moved rearward by the urging force of the coil spring 80, causing the engaging surface 491 to contact the shaft 145 from the front side. As a result, the ink cartridge 430 is retained in its attached state in the cartridge-attachment portion 4110.

When the ink cartridge 430 is in its attached state, the electrodes 65 on the circuit board 64 are positioned beneath the contacts 132 in a connector 4130 of the cartridge-attachment portion 4110. When the locking lever 490 is elastically returned in this state, the circuit board 64 is moved from the first position to the second position, whereby the electrodes 65 contact the corresponding contacts 132 from below and form electrical connections with the same.

In the structure illustrated in FIGS. 16 through 18, the engaging surface 491 is engaged with the shaft 145, but the engaging surface 491 may be engaged with the connector 4130 or another component other than the shaft 145.

In the structure illustrated in FIG. 16, a projection 119 is formed in the passage 75A in place of the valve 79 and coil spring 80. As the ink cartridge 430 is being inserted into the cartridge holder 4101, the projection 119 contacts the valve 115 from the rear side and pushes the valve 115 forward. As a result, the valve 115 moves forward against the urging force of the coil spring 116, thereby opening the opening 102B in the tube 102 (see FIG. 18).

In the third modification, the locking lever 490 that functions to retain the ink cartridge 430 in its attached state in the cartridge-attachment portion 4110 can also serve as the lever for bringing the electrodes 65 on the circuit board 64 into contact with the contacts 132.

Further, since the circuit board 64 is positioned on the locking lever 490 in the third modification, the circuit board 64 can move between the first position and second position in association with the movement of the locking lever 490.

In the third modification, the electrodes 65 face toward the front of the ink cartridge 430. Accordingly, when the user grips the ink cartridge 430 in order to mount the ink cartridge 430 in the cartridge-attachment portion 4110, for example, the user is less likely to touch the electrodes 65 since the electrodes 65 face away from the user.

<Other Variations>

The second arm 74 may be configured of a resilient material, such as rubber. In the lever 68, the shaft 70, first arm 73, and second arm 74 may be formed of the same material or of different materials. For example, the shaft 70, first arm 73, and second arm 74 may all be formed of a rubber, or the shaft 70 and first arm 73 may be formed of a resin while only the second arm 74 is formed of a rubber. Of course the shaft 70, first arm 73, and second arm 74 may all be formed of a resin, as well.

When the ink cartridge 30 is inserted farther forward than the position in which the ink cartridge 30 is retained in the cartridge-attachment portion 110, for example, the lever 68 could pivot farther than the amount required to move the circuit board 64 into the second position, causing the circuit board 64 to be pushed with more force than expected against the contacts 132. However, if the lever 68 has resiliency, as described above, the force with which the circuit board 64 is pressed against the contacts 132 at this time can be mitigated.

Note that the lever 68 itself need not have elasticity. In such a case, an urging member, such as a coil spring, may be disposed between the lever 68 and housing 31. With this configuration, the urging force of the urging member can mitigate the force with which the circuit board 64 is pressed against the contacts 132.

The direction in which the first arm 73 extends when the lever 68 is in its initial orientation is not limited to the forward and rearward directions. For example, the first arm 73 may extend in a direction sloped relative to the front-rear direction when the lever 68 is in its initial orientation. Of course, the direction in which the circuit board 64 extends may be modified at the same time.

Similarly, the direction in which the second arm 74 extends when the lever 68 is in the initial orientation is not limited to the upward direction. For example, the second arm 74 may extend in a direction sloped relative to the vertical when the lever 68 is in its initial orientation.

Figure 19:
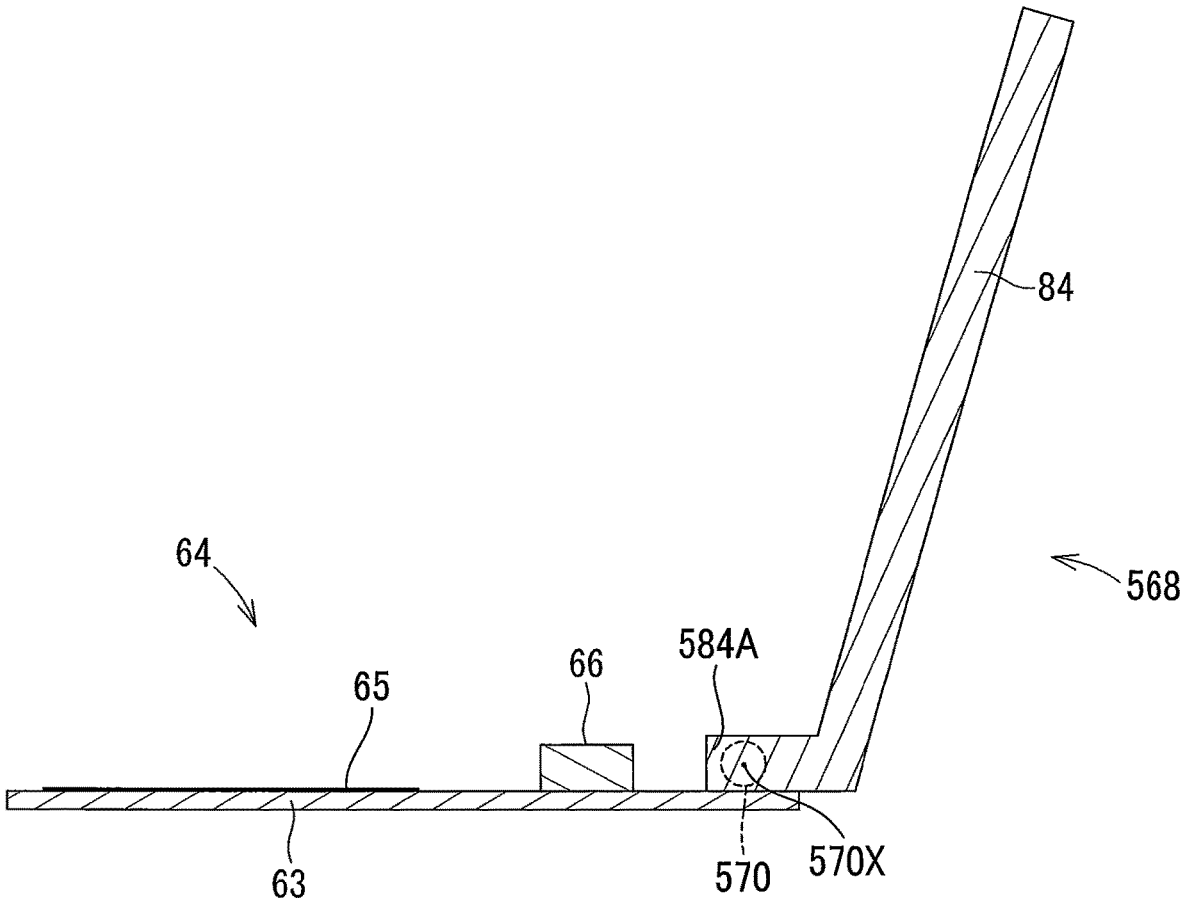
FIG. 19 is a side view of a lever and a circuit board according to a variation of the embodiment.

The lever 68 is not limited to a construction comprising two arms, i.e., the first arm 73 and second arm 74. As in the example illustrated in FIG. 19, a lever 568 may be configured of shafts 570, and a single arm 84 that extends from the shafts 570. The circuit board 64 may then be bonded to a proximal end portion 584A of the arm 84. Here, the arm 84 corresponds to the second arm 74 in the embodiment described above. The lever 568 pivots about a pivot axis 570X, and the pivot of the lever 568 moves the circuit board 64.

In the embodiment described above, the recessed part 69 is formed in the top wall 39, and the lever 68 is disposed in the recessed part 69. However, the recessed part 69 need not be formed in the top wall 39. In this case, the lever 68 is supported on the top surface 39A of the top wall 39, for example. Specifically, the lever 68 is pivotably supported by protruding parts that protrude from the top surface 39A of the top wall 39.

In the embodiment described above, the ink cartridge 30 is inserted along the front-rear direction. However, the insertion direction for the ink cartridge 30 is not limited to the front-rear direction. For example, the ink cartridge 30 may be configured to pivot inside the cartridge holder 101 during the process of being inserted into the same. Such pivot of the ink cartridge 30 is executed in order to engage the ink cartridge 30 with a locking member (for example, the shaft 145 in the embodiment described above) provided in the cartridge holder 101, for example.

By configuring the engaging surface 91 of the locking lever 90 to contact the shaft 145 from the front side, the ink cartridge 30 according to the embodiment is fixed in position in the front-rear direction through the engagement of the locking lever 90 and shaft 145. However, the positioning means for the ink cartridge 30 is not limited to this engagement between the locking lever 90 and shaft 145. For example, the ink cartridge 30 may be fixed in position in the front-rear direction through sliding resistance between the top surface on the protruding part 89 of the ink cartridge 30 and the bottom surface on the protruding part 114 of the cartridge-attachment portion 110, and sliding resistance between the bottom surface 42A of the ink cartridge 30 and the inner top surface on the bottom wall 59 of the cartridge-attachment portion 110. Alternatively, the ink cartridge 30 may be fixed in position in the front-rear direction through sliding resistance between the sealing member 76 of the ink cartridge 30 and the tube 102 of the cartridge-attachment portion 110, for example.

Figure 20:
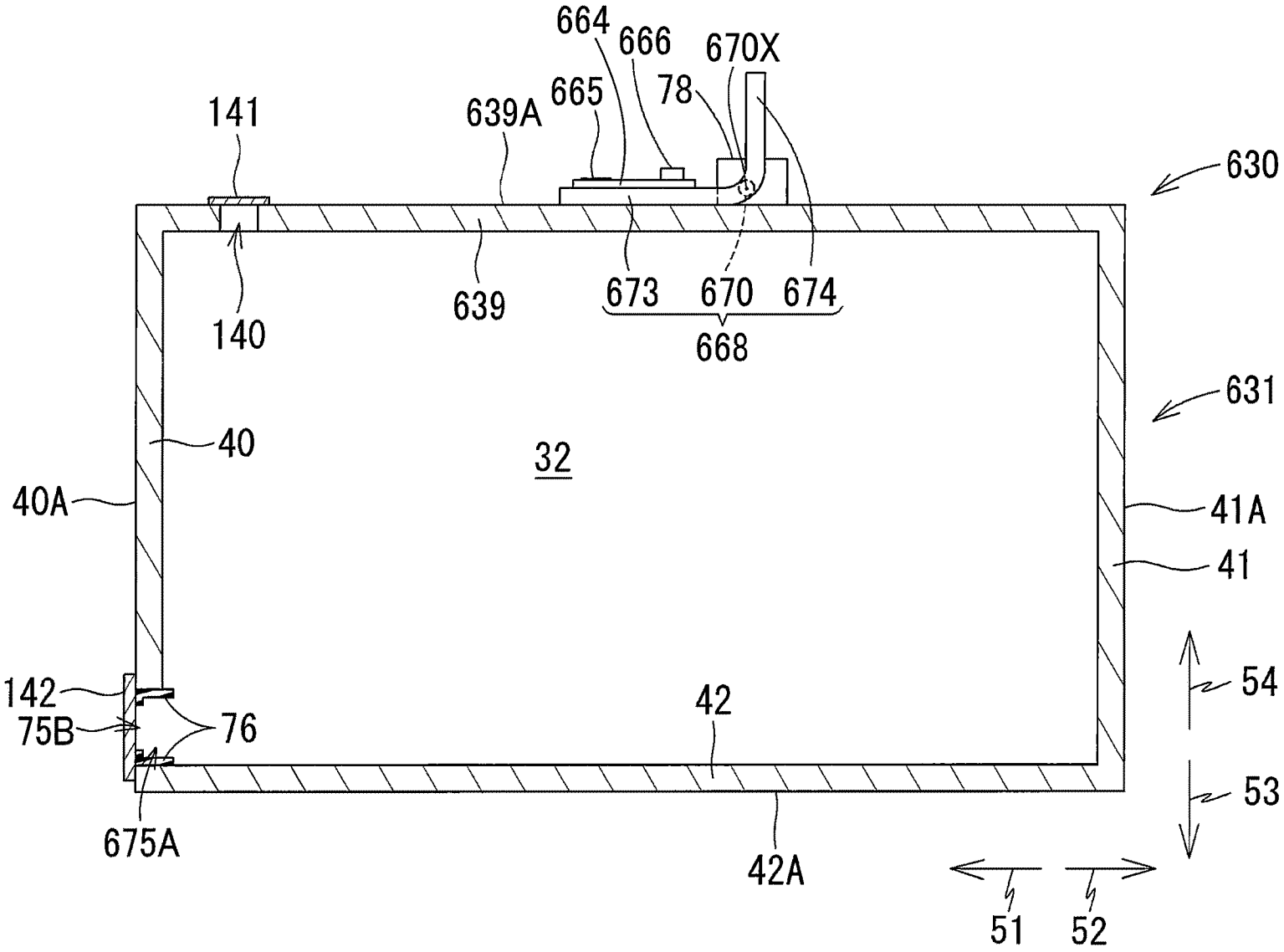
FIG. 20 is a vertical cross-sectional view of an ink cartridge according to another variation of the embodiment in the upright posture.

The ink cartridge 30 is not limited to structures like those illustrated in FIGS. 4, 5, 12, 14, and 16. For example, an ink cartridge 630 may be configured as illustrated in FIG. 20. In the structure of FIG. 20, the ink cartridge 630 includes a housing 631 having a general parallelepiped shape. The ink cartridge 630 in FIG. 20 is not provided with the projection 67, protruding part 89, locking lever 90, cylinder 75, recessed part 69, or the like. A seal 142 closes an opening 75B of a passage 675A. A lever 668 is pivotably supported on protruding parts 78 provided on a top surface 639A of a top wall 639 of the housing 631. The lever 668 is supported on the protruding parts 78 by shafts 670, and provided with a first arm 673, and a second arm 674, in addition to the shafts 670. However, the structure for pivoting the lever 668 is not limited to a structure employing the protruding parts 78.

As in the embodiment described above, the ink cartridge 630 having the structure illustrated in FIG. 20 is inserted along the front-rear direction into the cartridge holder 101 of the cartridge-attachment portion 110. The seal 141 is peeled off the ink cartridge 630 prior to inserting the ink cartridge 630. During the process of insertion, the tube 102 in the cartridge-attachment portion 110 punctures the seal 142. Also, the lever 668 pivots during the process of insertion, bringing the electrodes 65 into contact with the contacts 132, as in the embodiment described above.

In the embodiment described above, ink is described as an example of the liquid, but the liquid cartridge may store a liquid other than ink, such as a pretreatment liquid that is ejected onto sheets or the like prior to ink during a printing operation, or water for cleaning the recording head 21.

It should be apparent to those who skilled in the art that the embodiment, various modifications thereto and variations described above may be combined with one another as appropriate.

<Remarks>

The ink cartridges 30, 230, 330, 430, and 630 are an example of the liquid cartridge. The cartridge-attachment portions 110, 3110, and 4110 are an example of the attachment portion. The contacts 132 are an example of the contact of the device. The printer 10 is an example of the printing device. The housings 31, 231, 331, 431, and 631 are an example of the housing. The storage chamber 32 is an example of the liquid chamber. The passages 75A and 675A are an example of the liquid passage. The circuit board 64 is an example of the circuit board. The electrodes 65 are an example of the contact of the cartridge. The memory 66 is an example of the memory. The substrate 63 is an example of the substrate. The lever 68, 269, 368, 568, and 668 and locking lever 490 are an example of the pivoting member. The pivot axis 70X, 270X, 370X, 490X, 570X, and 670X are an example of the pivot axis. The front surface 40A is an example of the front surface. The rear surface 41A is an example of the rear surface. The top surface 39A, 239A, 339A, 439A, and 639A are an example of the upper surface. The bottom surface 42A is an example of the lower surface. The shafts 70, 270, 370, and 670 and the proximal end 490A of the locking lever 490 are an example of the shaft. The first arms 73, 273, 373, and 673 and the contact surface 492 are an example of the arm. The front surfaces 74A and 274A, the second arm 374, and the engaging surface 491 are an example of the contact part. The stoppers 83 are an example of the stopper. The engaging surface 491 is an example of the engaging surface. The cartridge holder 101, 3101, and 4101 are an example of the holder. The tube 102 is an example of the circulation tube. The connector 130 and 4130 are an example of the connector. The front wall 137 is an example of the first wall. The rear wall 136 is an example of the second wall. The right wall 138 is an example of the third wall. The left wall 139 is an example of the fourth wall.

What is claimed is:

1. A liquid cartridge configured to be inserted into an attachment portion of a printing device in an insertion direction crossing a gravitational direction and attached to the attachment portion in an upright posture, the attachment portion including a contact, the liquid cartridge comprising:

a housing comprising:

a liquid chamber storing liquid therein; and a liquid passage in communication with the liquid chamber and extending forward in the insertion direction from the liquid chamber, the liquid passage having a front end in the insertion direction, an opening being formed in the front end;

a circuit board movable between a first position and a second position relative to the housing, the circuit board comprising:

a contact electrically connectable to the contact of the device in an attached state of the liquid cartridge to the attachment portion, the contact of the cartridge facing upward in the upright posture when the circuit board is in the first position, the contact of the cartridge sloping relative to the insertion direction in the upright posture and being electrically connectable to the contact of the device in the attached state of the liquid cartridge when the circuit board is in the second position; and a memory electrically connected to the contact of the cartridge; and a pivoting member pivotably supported by the housing about a pivot axis extending in a widthwise direction perpendicular to the insertion direction and the gravitational direction, the pivoting member being configured to move the circuit board between the first position and the second position.

2. The liquid cartridge according to claim 1, wherein the contact of the cartridge is electrically connected to the contact of the device when the circuit board is in the second position in the attachment state of the liquid cartridge.

3. The liquid cartridge according to claim 1, wherein the housing has:

a front surface facing forward in the insertion direction in the upright posture, the opening of the liquid passage being open at the front surface;

a rear surface spaced apart from the front surface in the insertion direction, the rear surface facing rearward in the insertion direction in the upright posture, the liquid chamber being disposed between the front surface and the rear surface in the insertion direction;

an upper surface facing upward in the upright posture; and a lower surface spaced apart from the upper surface in the gravitational direction in the upright posture, the lower surface facing downward in the upright posture, the liquid chamber being disposed between the upper surface and the lower surface in the gravitational direction, and wherein the pivoting member is positioned at a position closer to the upper surface than to the lower surface in the gravitational direction.

4. The liquid cartridge according to claim 3, wherein the circuit board in the first position is positioned lower than the upper surface.

5. The liquid cartridge according to claim 1, wherein the pivoting member comprises:

a shaft extending in the widthwise direction and defining the pivot axis; and an arm extending from the shaft and supporting the circuit board.

6. The liquid cartridge according to claim 1, wherein the pivoting member has a contact part configured to make contact with the attachment portion in the attached state of the liquid cartridge.

7. The liquid cartridge according to claim 6, wherein the circuit board is positioned forward in the insertion direction relative to the pivot axis, and wherein the contact part extends upward from the pivot axis in the upright posture.

8. The liquid cartridge according to claim 7, wherein the attachment portion includes a connector in which the contact of the device is provided, the contact part being configured to contact the connector during insertion of the liquid cartridge into the attachment portion, and wherein contact of the contact part to the connector causes the pivoting member to pivot to move the circuit board from the first position to the second position during the insertion of the liquid cartridge into the attachment portion.

9. The liquid cartridge according to claim 1, wherein the circuit board is positioned rearward in the insertion direction relative to the pivot axis in the upright posture.

10. The liquid cartridge according to claim 9, further comprising a stopper positioned below the circuit board in the upright posture, the stopper being configured to maintain the circuit board at the first position.

11. The liquid cartridge according to claim 9, wherein the pivoting member has an engaging surface positioned rearward in the insertion direction relative to the circuit board in the upright posture, the engaging surface being configured to contact the attachment portion to hold the liquid cartridge in the attached state.

12. The liquid cartridge according to claim 11, wherein the circuit board is positioned between the pivot axis and the engaging surface on the pivoting member.

13. The liquid cartridge according to claim 12, wherein the contact of the cartridge faces upward and frontward in the insertion direction in the upright posture when the circuit board is in the second position.

14. The liquid cartridge according to claim 1, wherein the circuit board comprises a substrate extending perpendicular to the gravitational direction in the upright posture when the circuit board is in the first position.

15. The liquid cartridge according to claim 1, wherein the pivoting member has resiliency.

16. A system comprising:

the liquid cartridge according to claim 1; and an attachment portion of a printing device, the liquid cartridge being configured to be inserted into the attachment portion in the insertion direction and attached to the attachment portion in the upright posture, the attachment portion comprising:

a holder in which the liquid cartridge is inserted;

a circulation tube through which the liquid in the liquid chamber is allowed to flow out of the liquid chamber of the liquid cartridge in the attached state of the liquid cartridge; and a connector disposed in the holder, the connector comprising:

a contact configured to make contact with the contact of the cartridge in the attached state of the liquid cartridge;

a first wall having a first lower end in the gravitational direction, the first lower end being positioned lower than the contact of the device in the gravitational direction; and a second wall spaced apart from the first wall in the insertion direction, the second wall having a second lower end in the gravitational direction, the second lower end being positioned lower than the contact of the device in the gravitational direction, the contact of the device being positioned between the first wall and the second wall in the insertion direction.

17. The system according to claim 16, wherein the attachment portion further comprises a shaft positioned rearward in the insertion direction relative to the connector and extending in a widthwise direction crossing the insertion direction and the gravitational direction, wherein the pivoting member has a contact part configured to make contact with the attachment portion in the attached state of the liquid cartridge, and wherein the contact part contacts the shaft during the insertion of the liquid cartridge into the attachment portion and contact of the contact part to the shaft causes the pivoting member to pivot to move the circuit board from the first position to the second position during the insertion of the liquid cartridge into the attachment portion.

18. The system according to claim 16, wherein the pivoting member has a contact part configured to make contact with the attachment portion in the attached state of the liquid cartridge, and wherein the contact part contacts the connector during the insertion of the liquid cartridge into the attachment portion and contact of the contact part to the connector causes the pivoting member to pivot to move the circuit board from the first position to the second position during the insertion of the liquid cartridge into the attachment portion.

19. The system according to claim 16, wherein the connector further comprises:

a third wall having a third lower end in the gravitational direction, the third lower end being positioned lower than the contact of the device in the gravitational direction; and a fourth wall spaced apart from the third wall in a widthwise direction crossing the insertion direction and the gravitational direction, the fourth wall having a fourth lower end in the gravitational direction, the fourth lower end being positioned lower than the contact of the device in the gravitational direction, the contact of the device being positioned between the third wall and the fourth wall in the widthwise direction.

20. A liquid cartridge configured to be inserted into an attachment portion of a printing device in an insertion direction crossing a gravitational direction and attached to the attachment portion in an upright posture, the attachment portion including a contact, the liquid cartridge comprising:

a housing comprising:

a liquid chamber storing liquid therein; and a liquid passage in communication with the liquid chamber and extending forward in the insertion direction from the liquid chamber, the liquid passage having a front end in the insertion direction, an opening being formed in the front end;

a circuit board movable between a first position and a second position relative to the housing, the circuit board comprising:

a contact electrically connectable to the contact of the device in an attached state of the liquid cartridge to the attachment portion, the contact of the cartridge sloping relative to the insertion direction in the upright posture, the contact of the cartridge being disconnected from the contact of the device when the circuit board is in the first position, the contact of the cartridge being electrically connected to the contact of the device the attached state of the liquid cartridge when the circuit board is in the second position; and a memory electrically connected to the contact of the cartridge; and a pivoting member pivotably supported by the housing about a pivot axis extending in a widthwise direction perpendicular to the insertion direction and the gravitational direction, the pivoting member being configured to move the circuit board between the first position and the second position.

* * * * *